US009335095B2

(12) United States Patent
Bison et al.

(10) Patent No.: US 9,335,095 B2
(45) **Date of Patent: *May 10, 2016**

(54) APPLIANCE FOR DRYING LAUNDRY

(75) Inventors: Alberto Bison, Pordenone (IT); Igor Colin, Cordenons (IT); Maurizio Del Pos, Pordenone (IT); Paolo Olivaro, Orsago (IT)

(73) Assignee: Electrolux Home Products Corporation N.V., Brussels (BE)

( * ) Notice: Subject to any disclaimer, the term of this patent is extended or adjusted under 35 U.S.C. 154(b) by 258 days.

This patent is subject to a terminal disclaimer.

(21) Appl. No.: 13/978,049

(22) PCT Filed: Dec. 28, 2011

(86) PCT No.: PCT/EP2011/074132

§ 371 (c)(1),
(2), (4) Date: Oct. 11, 2013

(87) PCT Pub. No.: WO2012/093059

PCT Pub. Date: Jul. 12, 2012

(65) Prior Publication Data

US 2014/0026433 A1 Jan. 30, 2014

(30) Foreign Application Priority Data

Jan. 4, 2011 (EP) ..... 11150054

(51) Int. Cl.
*D06F 58/26* (2006.01)
*F26B 25/16* (2006.01)
(Continued)

(52) U.S. Cl.
CPC ..... *F26B 25/16* (2013.01); *D06F 39/12* (2013.01); *D06F 58/02* (2013.01); *D06F 58/10* (2013.01); *D06F 58/16* (2013.01); *D06F 58/18* (2013.01); *D06F 58/20* (2013.01); *D06F 58/24* (2013.01)

(58) Field of Classification Search
CPC ..... F26B 11/00; F26B 11/03; F26B 19/00; F26B 21/00; F26B 21/03; D06F 58/00; D06F 58/20; D06F 58/26
USPC ..... 34/595, 601, 606, 610; 68/5 C, 5 R, 19, 68/20; 8/137, 149, 159
See application file for complete search history.

(56) References Cited

U.S. PATENT DOCUMENTS 2,722,057 A * 11/1955 Pugh ..... 34/74
3,190,011 A * 6/1965 Shields ..... 34/77
(Continued)

FOREIGN PATENT DOCUMENTS

CH 462 085 * 9/1968
CH 462085 A 9/1968
(Continued)

OTHER PUBLICATIONS

International Search Report mailed Mar. 28, 2012 in corresponding International Application No. PCT/EP2011/074132.
(Continued)

*Primary Examiner* — Stephen M Gravini
(74) *Attorney, Agent, or Firm* — Banner & Witcoff, Ltd.

(57) ABSTRACT

A top adapted to match and close from above a cabinet of a laundry drying appliance is provided. The top is formed as a ready-to-mount part ready to be mounted to the cabinet and forming a moisture condensing module for dehydrating drying air used to dry laundry within a drying drum of the laundry drying appliance. The top has a drying air inlet for receiving moisture-laden drying air, a drying air outlet for delivering demoisturized drying air, fluid passageways defined thereinside from the drying air inlet to the drying air outlet for the passage of the drying air to be dehydrated and a moisture condenser arranged inside the fluid passageways. The top includes, integrally formed therein, at least one structural part of the appliance, the at least one structural part of the appliance having at least one of: a part a housing of a fan for propelling the drying air; a drying air delivery duct connectable to a drying air inlet of the drying drum for delivering the drying air into the drying drum; a seat for a container of detergents/softener for washing laundry; a condense water collector for collecting condense water released by the moisture-laden drying air; at least part of a condense water draining system; a support for at least one water inlet valve for selectively allowing the intake of water from a water main; and at least part of a water circuit for delivering water to wash the moisture condensing means.

15 Claims, 28 Drawing Sheets

(51) Int. Cl.

| | |
|---|---|
| ***D06F 39/12*** | (2006.01) |
| ***D06F 58/02*** | (2006.01) |
| ***D06F 58/10*** | (2006.01) |
| ***D06F 58/16*** | (2006.01) |
| ***D06F 58/18*** | (2006.01) |
| ***D06F 58/20*** | (2006.01) |
| ***D06F 58/24*** | (2006.01) |

(56) References Cited

U.S. PATENT DOCUMENTS

| | | | | |
|---|---|---|---|---|
| 4,137,645 | A | 2/1979 | Bullock | |
| 4,268,247 | A * | 5/1981 | Freze | 432/21 |
| 4,949,477 | A | 8/1990 | Geiger | |
| 5,588,313 | A | 12/1996 | Hildebrand | |
| 6,954,995 | B2 * | 10/2005 | Kitamura et al. | 34/597 |
| 7,367,137 | B2 * | 5/2008 | Jonsson et al. | 34/265 |
| 7,716,850 | B2 * | 5/2010 | Deem et al. | 34/117 |
| 7,921,578 | B2 * | 4/2011 | McAllister et al. | 34/597 |
| 8,028,439 | B2 * | 10/2011 | Prajescu | 34/601 |
| 8,112,904 | B2 * | 2/2012 | Kono et al. | 34/595 |
| 2006/0277690 | A1 | 12/2006 | Pyo et al. | |
| 2007/0151120 | A1 | 7/2007 | Tomasi et al. | |
| 2011/0265523 | A1 * | 11/2011 | Bison et al. | 68/20 |
| 2012/0131811 | A1 * | 5/2012 | Del Pos et al. | 34/73 |
| 2012/0137536 | A1 * | 6/2012 | Del Pos et al. | 34/108 |
| 2012/0159997 | A1 * | 6/2012 | Del Pos et al. | 68/13 R |
| 2014/0026433 | A1 * | 1/2014 | Bison et al. | 34/73 |
| 2014/0190220 | A1 * | 7/2014 | Lee et al. | 68/17 R |
| 2014/0250607 | A1 * | 9/2014 | Favaro et al. | 8/137 |

FOREIGN PATENT DOCUMENTS

| | | | | |
|---|---|---|---|---|
| DE | 1610198 | A1 | 8/1971 | |
| DE | 7147026 | | 3/1972 | |
| DE | 2839389 | A1 | 3/1980 | |
| DE | 19504034 | A1 | 9/1995 | |
| EP | 254018 | A1 * | 1/1988 | D06F 58/24 |
| EP | 0552843 | A1 | 7/1993 | |
| EP | 1146161 | A1 | 10/2001 | |
| EP | 1411163 | A2 | 4/2004 | |
| EP | 1431442 | | 6/2004 | |
| EP | 1584734 | A2 | 10/2005 | |
| EP | 1634984 | A1 | 3/2006 | |
| EP | 1845185 | A1 | 10/2007 | |
| EP | 1854916 | A1 * | 11/2007 | D06F 25/00 |
| EP | 2039819 | A1 | 3/2009 | |
| EP | 2199453 | A1 | 6/2010 | |
| GB | 2075559 | A | 11/1981 | |
| GB | 2248920 | A * | 4/1992 | D06F 25/00 |
| JP | 2004135715 | A * | 5/2004 | D06F 25/00 |
| SU | 1587093 | | 8/1990 | |
| WO | 95/28515 | A1 | 10/1995 | |
| WO | 2006097901 | | 9/2006 | |
| WO | 2009/077308 | A1 | 6/2009 | |

OTHER PUBLICATIONS

Extended European Search Report dated Jul. 29, 2011 in corresponding EP Application No. 11150054.2.

European Office Action dated Apr. 5, 2013 in corresponding EP Application No. 11150054.2.

U.S. Appl. No. 13/381,512, Office Action mailed Aug. 27, 2015.

U.S. Appl. No. 13/381,515, Office Action mailed Oct. 6, 2015.

* cited by examiner

FIG. 5A
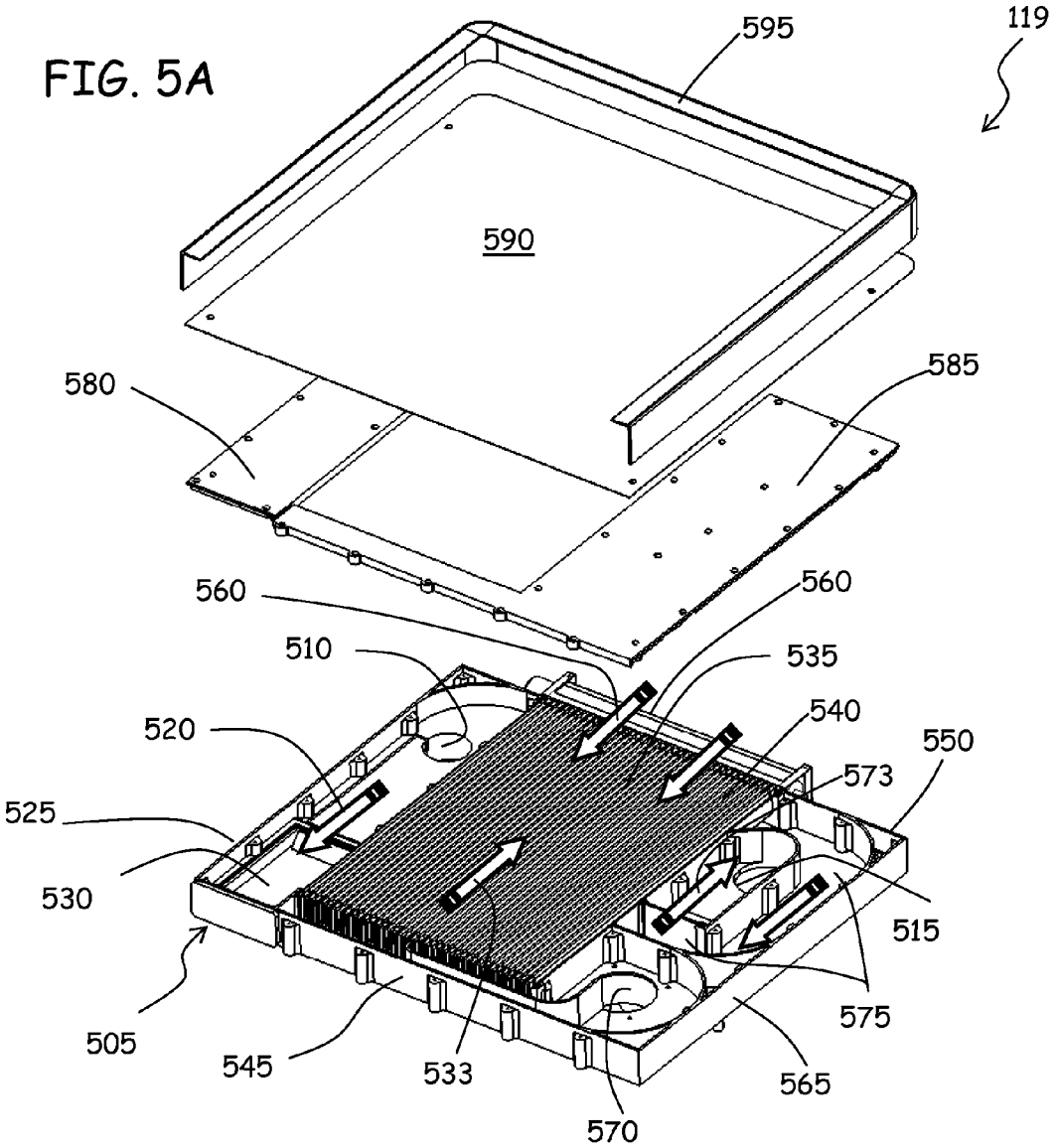
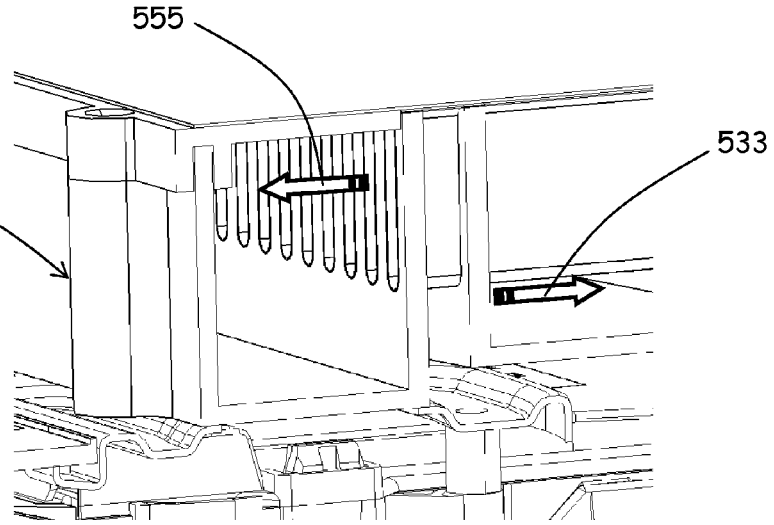
FIG. 6

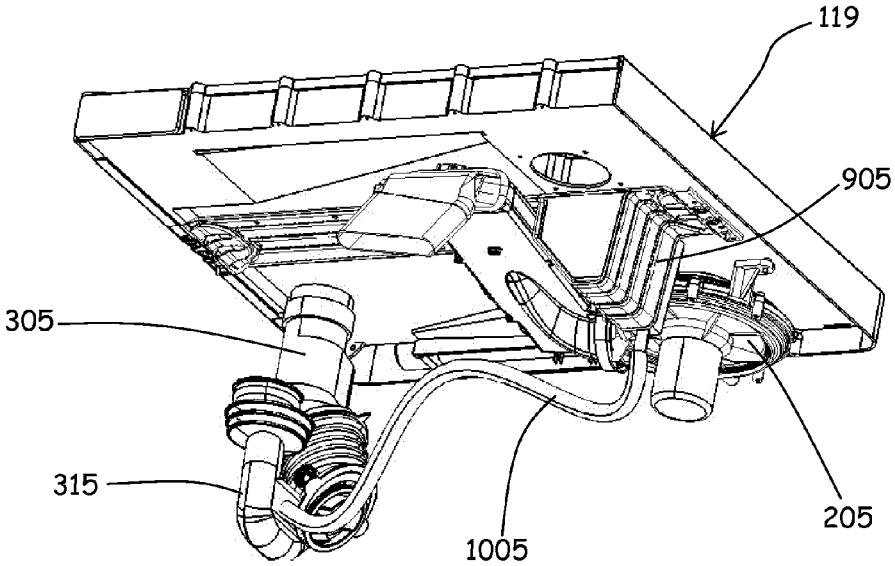
FIG. 10
FIG. 12
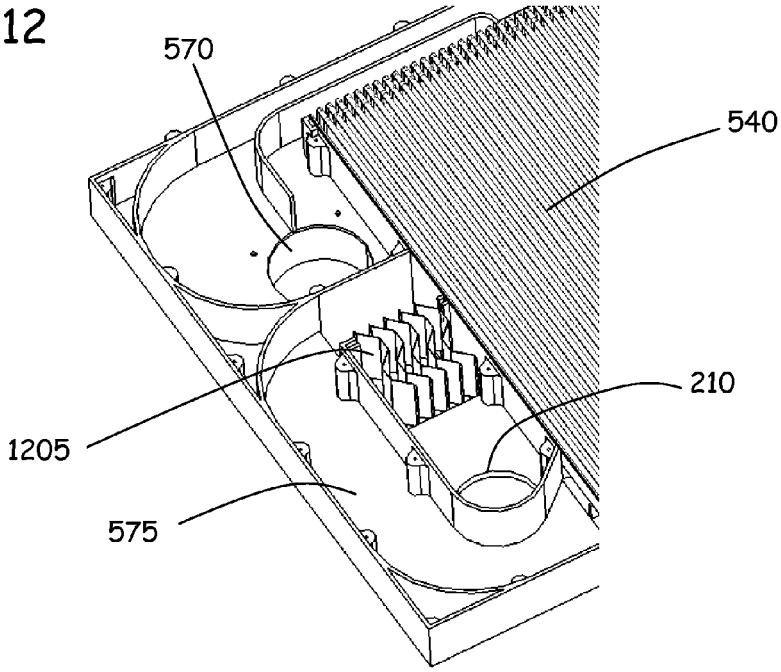

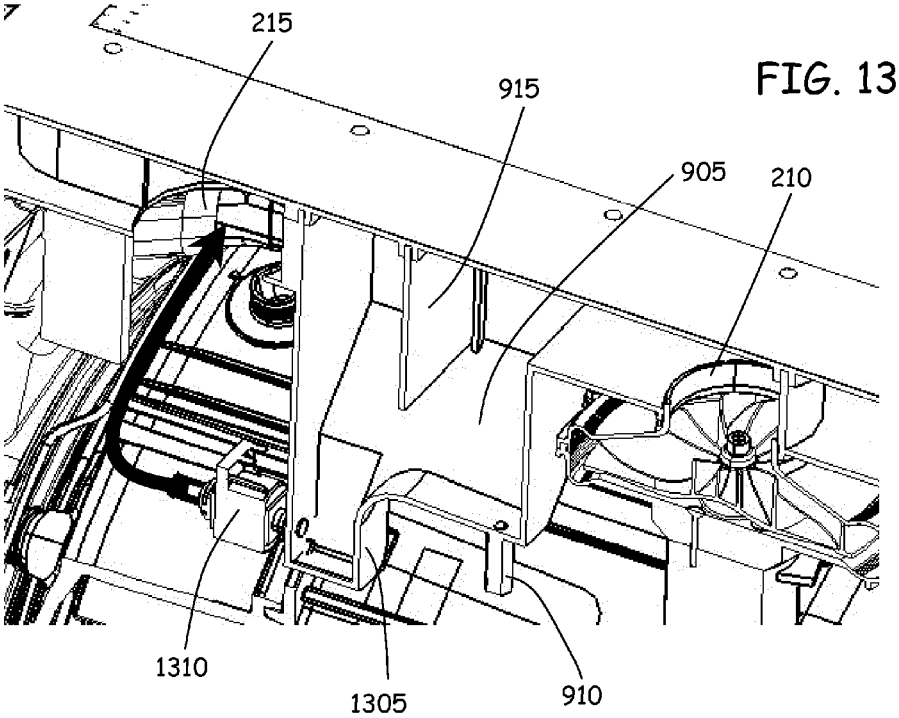
FIG. 13
FIG. 14A
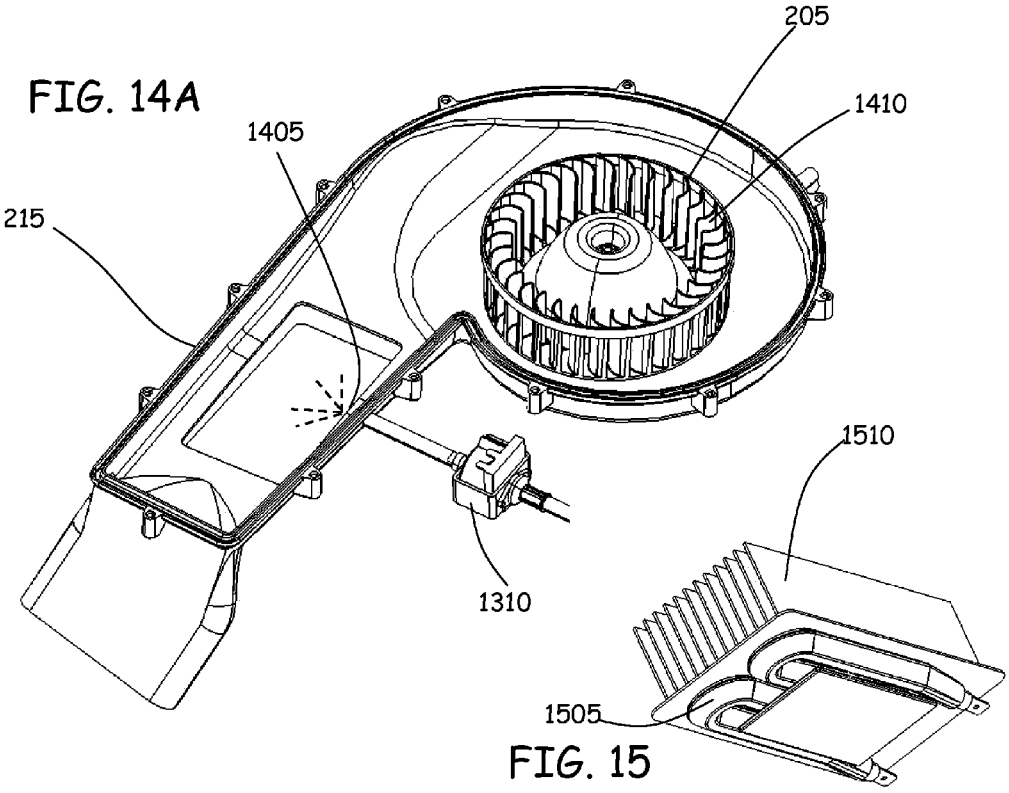
FIG. 15

FIG. 40
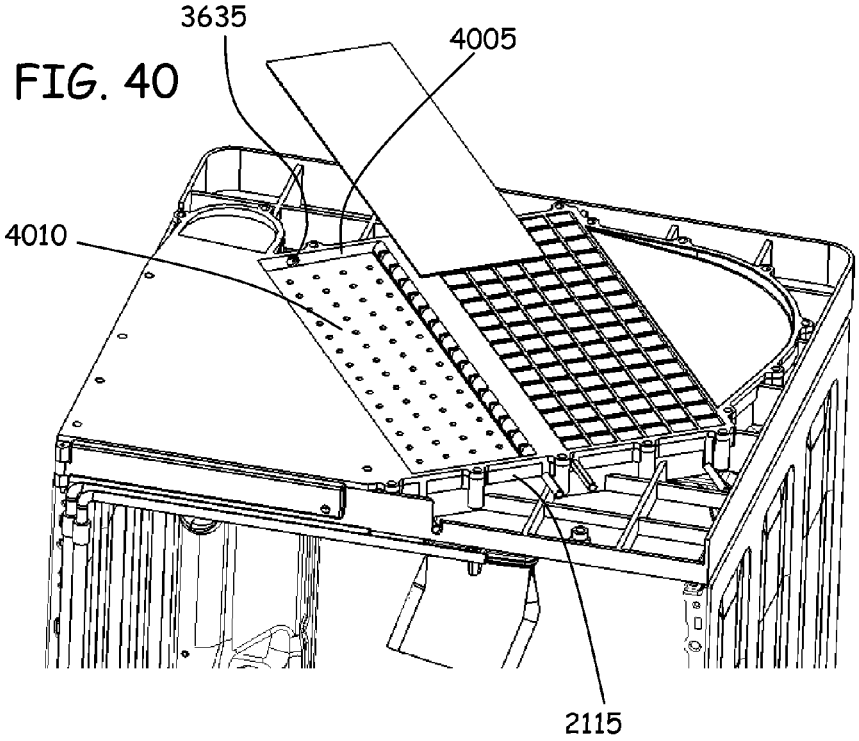
FIG. 41
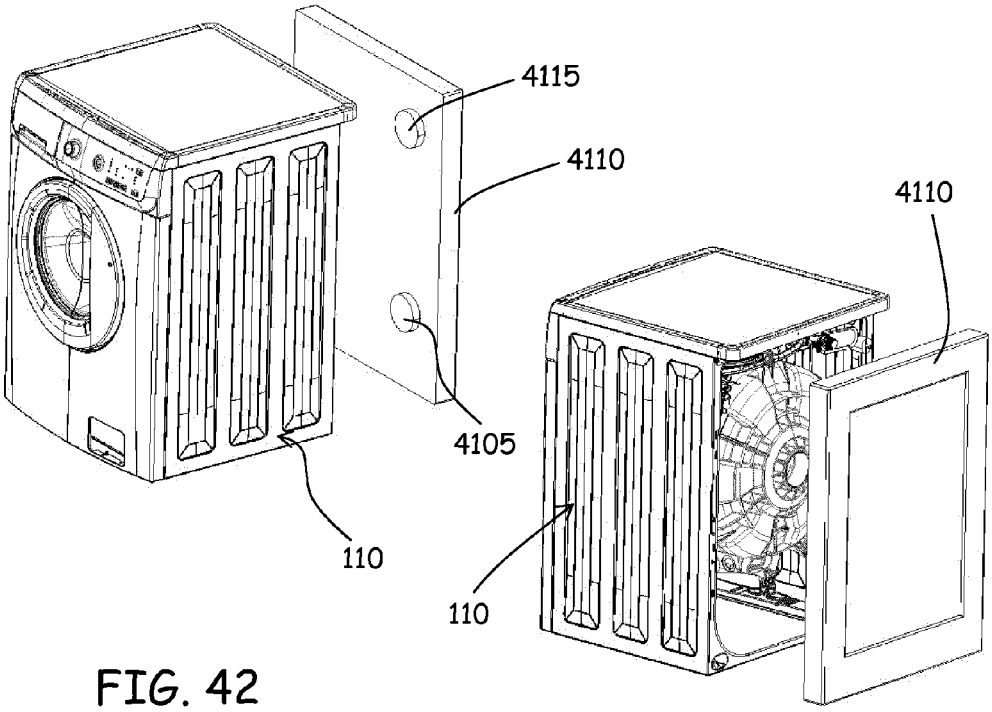
FIG. 42

APPLIANCE FOR DRYING LAUNDRY

BACKGROUND OF THE INVENTION

1. Field of the Invention

The present invention generally relates to the field of household appliances for laundry and garments treatment. In particular, embodiments of the present invention relates to appliances for drying laundry, such as laundry dryers and combined washers/dryers.

2. Discussion of the Related Art

Appliances for drying laundry, are adapted to dry clothes, garments, laundry in general, by circulating hot, dry air within a tumbler or drum. The drum is rotatably accommodated within a machine cabinet, and is designed to contain the articles to be dried. The rotation of the drum causes agitation of the articles to be dried, while they are hit by the drying air flow.

Combined laundry washer/dryer appliances combine the features of a washing machine with those of a dryer; in these appliances, the drum is rotatably accommodated within a washing tub.

In a known type of laundry dryers and washers/dryers, also referred to as "condenser dryer", the drying air flow is typically caused to pass through the drum, exiting therefrom from the front access opening, then it passes through a moisture condensing system, where the humid air is at least partially dehydrated, dried, and the dried air flow is heated up by means of a heating arrangement, like an electrical resistance; the heated drying air flow then passes again through the drum, and repeats the cycle.

The condensing system may be an air-air heat exchanger, exploiting air taken in from the outside. Examples of laundry dryers exploiting this type of condensing system are provided in EP 254018, EP 1584734, EP 2039819, GB 2075559.

Other known dryers and washers/dryers exploit a heat pump to dehydrate the drying air flow; in these dryers, the function of the heating arrangement may be performed by the heat pump itself, and the electrical resistance may thus not be provided for. Examples of laundry dryers exploiting a heat pump condenser are provided in JP2004135715, EP 1411163, EP 1634984.

Other known solutions exploit a water spray condenser for cooling the drying air. For example, EP 0552843 describes a washing and drying machine including, for the drying part, a steam condenser communicating with the inside of the washing container to receive the steam emanated by the washed laundry contained in the drum and with a nozzle for spraying cold water for the condensation of said steam, an aspirator associated with said condenser for the aspiration of the condensed steam formed in said condenser and for its conveyance to a drying area for the formation of dry hot air and a recirculation conduit of dry hot air inside said container. A water spray condenser is also described in GB2248920.

For some household appliance manufacturers, it might be interesting to exploit the already existing design of a washer for producing and offering to the customers a washer/dryer. The addition of those components and parts, that are necessary for the laundry drying function, should have as low as possible impact on the already existing design; in particular, the additional components should be housed within the already existing washer cabinet. This may be a cumbersome task, because of space constraints.

SUMMARY OF THE INVENTION

The Applicant has faced the problem of how to reduce the encumbrance of the components necessary for the drying air circulation, particularly suitable for the implementation in a washer/dryer.

According to an aspect of the present invention, there is provided a top adapted to match and close from above a cabinet of a laundry drying appliance.

The top is formed as a ready-to-mount part ready to be mounted to the cabinet and forming a moisture condensing module for dehydrating drying air used to dry laundry within a drying drum of the laundry drying appliance.

The top has a drying air inlet for receiving moisture-laden drying air, a drying air outlet for delivering demoisturized drying air, fluid passageways defined thereinside from said drying air inlet to said drying air outlet for the passage of the drying air to be dehydrated and moisture condensing means arranged inside said fluid passageways.

The top comprises, integrally formed therein, at least one structural part of the appliance, said at least one structural part of the appliance comprising at least one of the following:

- a part of a housing of a fan operable for propelling the drying air;
- a drying air delivery duct connectable to a drying air inlet of the drying drum for delivering the drying air into the drying drum;
- a seat for a container of detergents/softener for washing laundry;
- condense water collecting means for collecting condense water released by the moisture-laden drying air;
- at least part of a condense water draining system;
- a support for at least one water inlet valve for selectively allowing the intake of water from a water main;
- at least part of a water circuit for delivering water to clean the moisture condensing means.

The top may have a top surface, a bottom surface and a lateral wall, and said drying air inlet and said drying air outlet may be either provided on the bottom surface or on said lateral wall.

Said part of fan housing that is formed integrally to the top may define a first half-shell of the fan housing, to which a part defining a second half-shell is couplable for defining a shell accommodating therein a fan wheel.

Said drying air delivery duct may be formed integrally to either the part of fan housing that is formed integrally to the top, or to the part defining the second half-shell.

Said at least part of a condense water draining system may comprise a conduit fluidly connecting the condense water collecting means to the seat for the detergents/softener container.

Said top may comprise a water delivery assembly comprising means for delivering water into the seat for the detergents/softener container.

Said detergents/softener container may be a drawer slidably accommodated within the seat and having one or more detergents/softener compartments.

Said at least part of the water circuit for delivering water to clean the moisture condensing means may comprise at least one nozzle for sprinkling water onto the moisture condensing means, said nozzle being fed with water coming either from said water main or from said condense water collecting means.

Said at least part of the water circuit for delivering water to clean the moisture condensing means may be connected or connectable to a pump for pumping the water from the condense water collecting means to said nozzle.

Said at least part of the water circuit for delivering water to wash the moisture condensing means may comprise a pump for pumping the water from the condense water collecting means to said nozzle.

Said at least part of the water circuit for delivering water to clean the moisture condensing means may be connected or connectable to at least one valve for selectively feeding water from the water main to said nozzle.

Said at least part of the water circuit for delivering water to clean the moisture condensing means may comprise at least one valve for selectively feeding water from the water main to said nozzle.

Said moisture condensing means may comprise a first heat exchanger of a heat pump circuit, said first heat exchanger being operable for cooling and dehydrating the moisture-laden drying air.

According to another aspect of the present invention, there is provided a laundry drying appliance, comprising a cabinet having a top, a rotatable drying drum accommodated within in the cabinet, and a laundry drying air circulation system for circulating drying air. The top is in accordance to the previous aspect of the invention, and the drying air circulation system may comprise a drying air drum outlet connectable to the drying air inlet of the top, and a drying air drum inlet connectable to the drying air outlet of the top.

According to still another aspect of the present invention, there is provided a panel adapted to match and close a side of a cabinet of a laundry drying appliance, for example a rear side. The panel may be formed as a ready-to-mount part ready to be mounted to the cabinet and forming a moisture condensing module for dehydrating drying air used to dry laundry within a drying drum of the laundry drying appliance. The panel may comprise a drying air inlet, a drying air outlet, fluid passageways defined thereinside from said drying air inlet to said drying air outlet for the passage of the drying air to be dehydrated, and moisture condensing means arranged inside said fluid passageways.

Said moisture condensing means may comprises a heat pump.

According to still another aspect of the present invention, there is provided a top adapted to match and close from above a cabinet of a laundry drying appliance, the top being formed as a ready-to-mount part ready to be mounted to the cabinet and forming a moisture condensing module for dehydrating drying air used to dry laundry within a drying drum of the laundry drying appliance. The top may comprise a drying air inlet, a drying air outlet, fluid passageways defined thereinside from said drying air inlet to said drying air outlet for the passage of the drying air to be dehydrated and moisture condensing means arranged inside said fluid passageways. The top may comprise a top surface, a bottom surface and a lateral wall, and said drying air inlet and said drying air outlet are provided on said lateral wall.

BRIEF DESCRIPTION OF THE DRAWINGS

These and other features and advantages of the present invention will better appear by reading the following detailed description of some embodiments thereof, provided merely by way of non-limitative examples, description that should be read in conjunction with the attached drawings, wherein:

FIG. 5A shows in perspective exploded view a worktop of the appliance of FIG. 2, in an embodiment of the present invention;

FIG. 6 shows a detail of the worktop of FIG. 5A;

FIG. 10 shows a condense water drainage arrangement for draining condense water from the worktop of FIGS. 5A and 5B;

FIG. 12 shows still another alternative embodiment of the mist separation means;

FIG. 13 schematically shows an arrangement for exploiting condense water released by the drying air for generating steam used for refreshing the items to be dried;

FIGS. 14A and 15 shows a solution for generating refreshing steam, in an embodiment of the present invention; in addition, FIG. 14A also shown an alternative construction of a drying air circulation fan and drying air conduit for delivering drying air to the drum;

FIGS. 36-39 and 40 show schematically embodiments of the present invention which enable washing the evaporator exploiting water coming from a water main or condense water originating from the dehydration of the moisture-laden drying air; and FIGS. 41-45 show an embodiment of the present invention according to which the moisture condensing module for dehydrating drying air used to dry laundry is realized as a rear panel of the machine, instead of in the form of a worktop.

DETAILED DESCRIPTION OF EMBODIMENTS OF THE INVENTION

Figure 1:
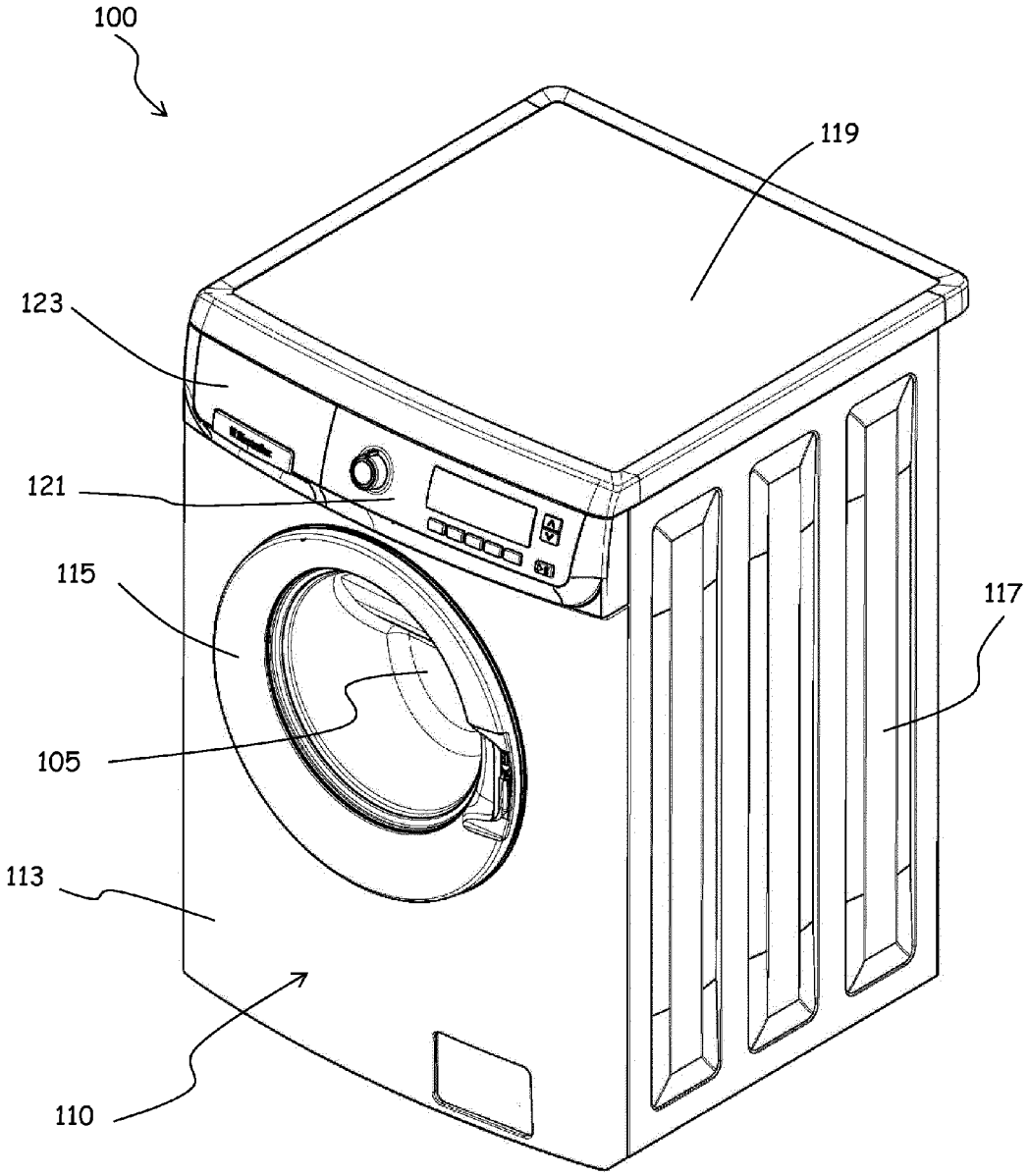
FIG. 1 is a perspective from the front of an appliance for drying laundry according to an embodiment of the present invention, with a worktop forming a ready-to-mount moisture condensing module for dehydrating drying air used to dry laundry within a drying drum of the laundry drying appliance.

With reference to the drawings, a laundry drying appliance, particularly a washer/dryer according to an embodiment of the present invention is depicted in FIG. 1 in perspective. The washer/dryer, globally denoted as 100, comprises a drum 105 for the loading of the articles to be washed and/or dried, such as clothes, garments, linen, and similar articles. The drum 105 is a generically cylindrical body, for example made of stainless steel, and is rotatable within a tub housed in the machine casing or cabinet 110.

The cabinet 110 is generically a parallelepiped in shape, and has a front wall 113, two side walls 117, a rear wall, a basement and a worktop (top) 119. The front wall 113 is provided with an opening for accessing the drum 105 and with an associated door 115 for closing the opening. In the upper part of the front wall 113, a machine control panel 121 is located, and, aside the control panel 121, a drawer 123, part of a washing treatment products dispensing arrangement, for loading laundry washing treatment products like detergents and softeners. The top 119 closes the cabinet 110 from above, and defines a worktop.

In the washer/dryer 100, when operated in dryer mode, drying air is typically caused to flow through the drum 105, where the items to be dried are contained. After exiting the drum 105, the flow of moisture-laden drying air passes through a moisture condensing system, where the humid drying air is at least partially dried, dehydrated, and the dehydrated air flow is then heated and caused to pass again through the drum 105, and repeats the cycle.

In the following, several solutions according to embodiments of the present invention and possible variants thereof will be presented; essentially, the solutions that will be presented belong to either one of two general classes, mainly differing from each other for the type of moisture condensing system, which in one case comprises an air-air heat exchanger, whereas in the other case the moisture condensing system comprises a heat pump.

FIGS. 2 to 16 show, in different views, a solution according to an embodiment of the present invention, in which the moisture condensing system comprises, as mentioned, an air-air heat exchanger, described in detail in the following.

Figure 2:
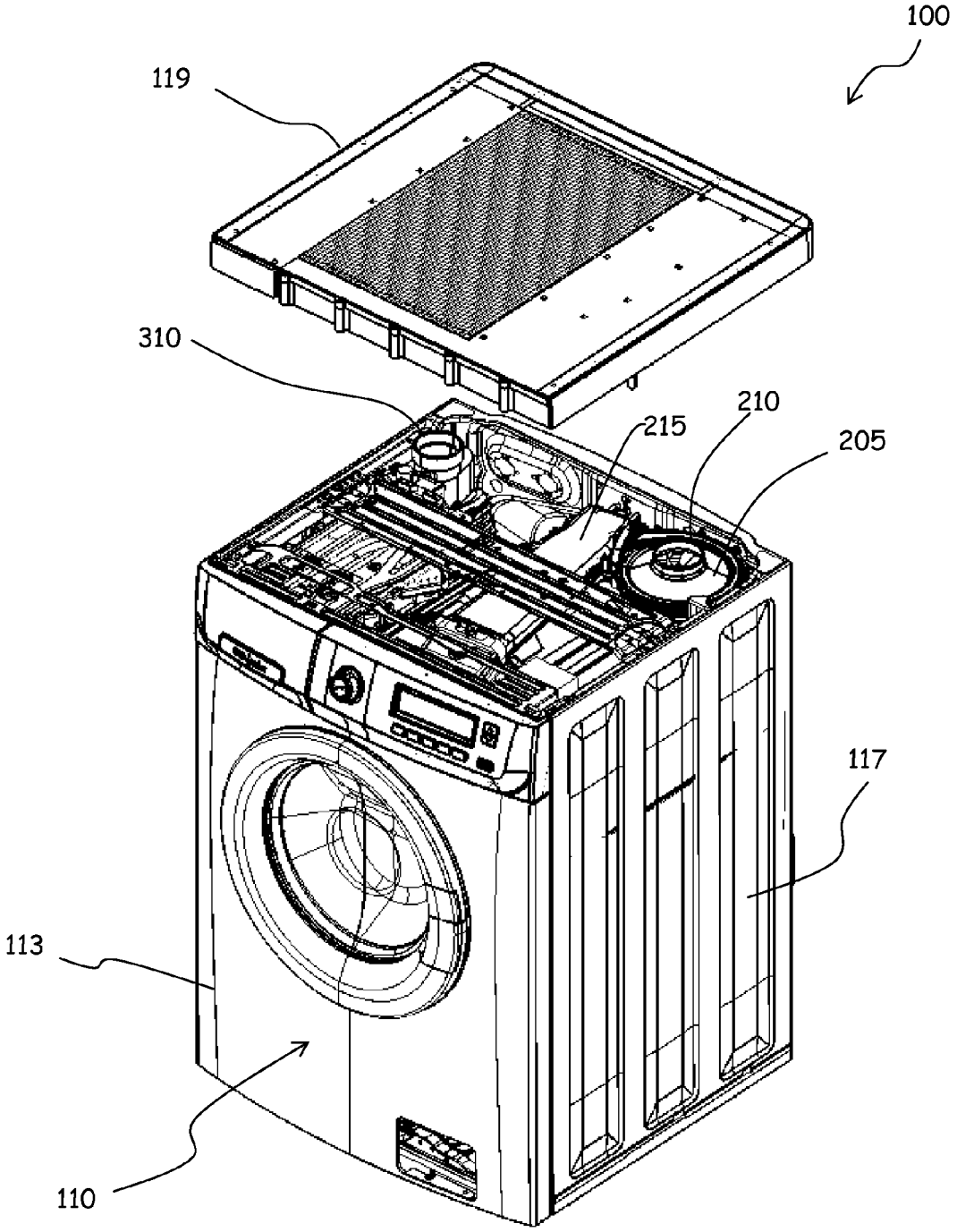
FIG. 2 shows in perspective the appliance of FIG. 1 with the worktop unmounted.
Figure 3B:
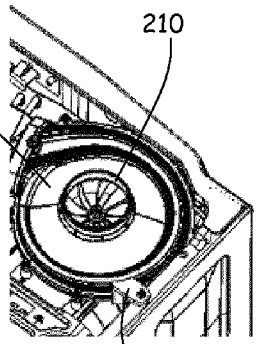
FIG. 3B shows a detail of FIG. 3A from another point of view.
Figure 3A:
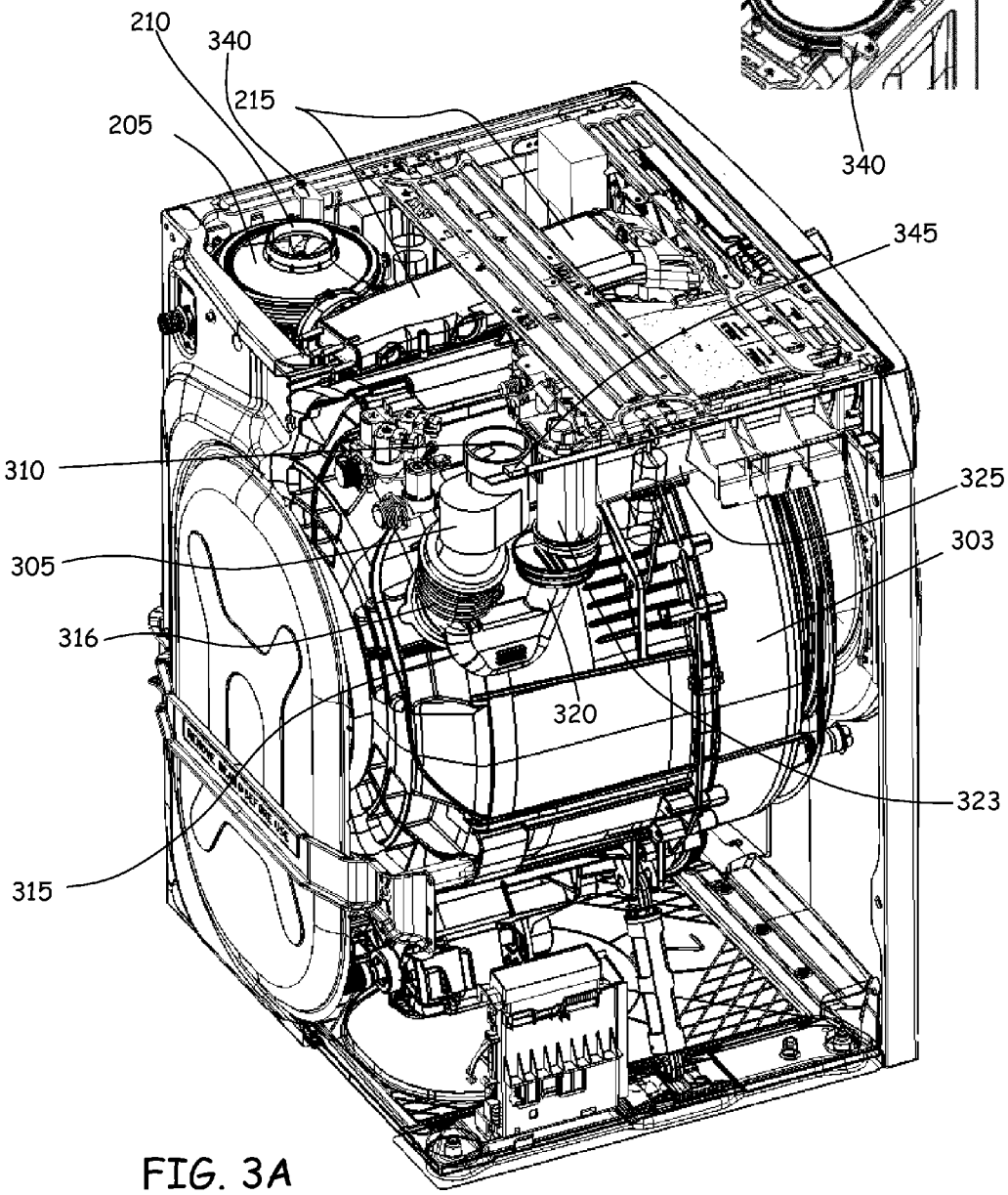
FIG. 3A shows in perspective from the rear the appliance of FIG. 2, with lateral and rear walls of the cabinet removed.

As visible in particular in FIGS. 2 and 3A, 3B, a drying air circulation system is provided in the washer/dryer 100. The drying air circulation system comprises a fan 205, for example arranged at the rear of the cabinet 110, near the right-top corner thereof. The fan 205, which is fixedly mounted to the cabinet 110, for example by means of a bracket 340 so as to be rigidly connected to the cabinet 110, has an air intake 210 facing upwards and which opens towards the top 119. The fan 205 has an outlet coupled to an inlet of an air duct 215 that runs at the top of the cabinet 110 from the rear to the front thereof, and, through a bellow (not visible in the drawings), conveys the drying air impelled by the fan 205 into the tub 303 and the drum 105 accommodated therein. In particular, in the shown embodiment the drying air enters the tub 303 and the drum 105 in correspondence of the front thereof (for this reason, since in the exemplary embodiment here considered the fan 205 is located at the rear of the appliance, the air duct 215 runs from the rear to the front of the cabinet 110); this however is just a matter of design and choice, and nothing prevents from having the drying air entrance into the tub 303 located in different positions, for example at the rear of the cabinet 110 (in which case, if the fan 205 is as well located at the rear, there is no need of having an air duct running from the rear to the front of the cabinet 110).

An air heater, for example an electrical resistor, is preferably accommodated within the air duct 215 for heating up the drying air before it enters the drum 105. The drying air circulation system further comprises a return air duct 305, arranged at the rear of the cabinet 110, near the left-top corner thereof and fixedly mounted to the cabinet 110, for example by means of a bracket 345, so as to be rigidly connected to the cabinet 110; the return air duct 305 receives the drying air exiting the drum 105 and the tub 303, and has an outlet 310 that faces upwards and opens towards the top 119; in particular, the drying air exits the drum 105 at the rear thereof, after having passed through the drum so as to hit the items to be dried that are present therein.

Figure 4:
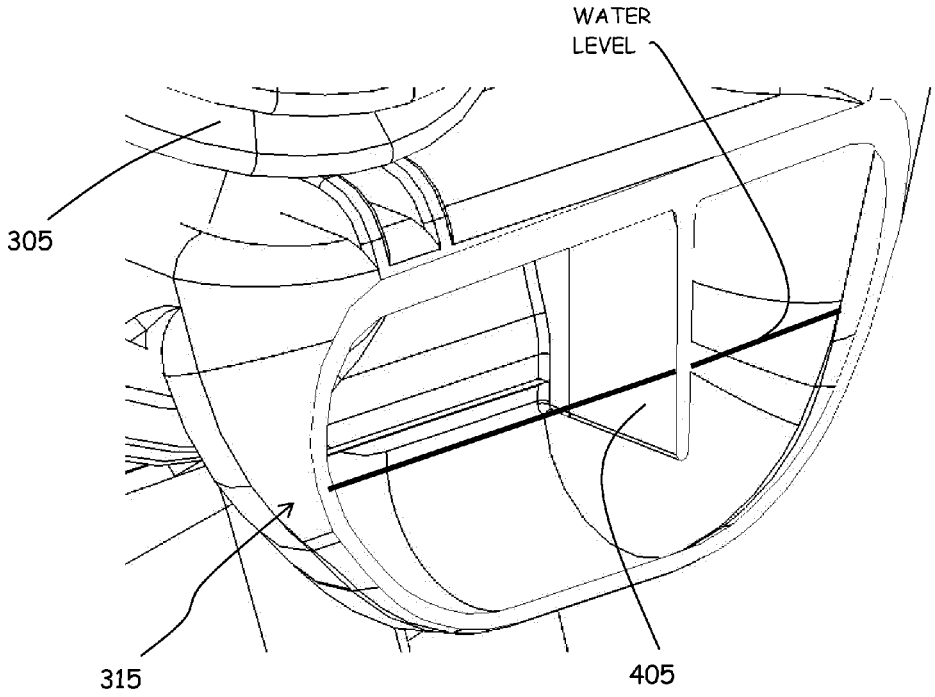
FIG. 4 shows in enlarged scale a detail of a part of the appliance of FIG. 3A.

As visible in FIGS. 3A, 3B and 4, according to an embodiment of the present invention, the return air duct 305 receives the drying air exiting from the drum 105 and the tub 303 through an opening in the tub 303 already provided for feeding thereto the laundry washing treatment products (detergents, softeners) and the clean water used to wash the laundry when the washer/dryer is operated in washing mode. In particular, a manifold 315 is provided, coupled to the opening in the tub 303. The manifold 315 has an inlet pipe 320 that is coupled, by means of a bellow and a duct 323, to an arrangement 325 for dispensing to the tub 303 the laundry washing treatment products (the dispensing arrangement comprising for example a detergent/softener container, one or possibly two electrovalves for intaking cold and possibly hot water from water mains, possibly a mixing chamber for mixing treatment products and water). The manifold 315 has an outlet opening to which, by means of a bellow 316, the return air duct 305 is connected. Internally, the manifold 315 has a baffle 405 extending down from a top wall of the manifold 315 and defining a siphon: the siphon allows that part of the laundry washing treatment liquid (water mixed with the detergent of the softener, or, possibly, simply water) remains at the bottom of the manifold 315, thereby preventing that, when the appliance is operated in drying mode, the drying air exiting the tub 303 leaks into the treatment products dispending arrangement 325, and that for this reason heat is lost, and, at the same time, that humid, moisture-laden air is released into the external environment (passing through the detergent container), which is regarded as undesired because the washer/dryer is installed in-house and humidity released in the environment may cause problems.

Part of the drying air circulation system is entirely accommodated within the top 119. As visible in the exploded view of FIG. 5A, the top 119 comprises a base element 505, visible from below in FIG. 5B, having shape and size adapted to match and close from above the cabinet 110 when the top 119 is mounted thereto. Proximate to the two rear corners thereof, the base element 505 has two openings 510 and 515 formed in its bottom wall; as better described in the following, when the top 119 is assembled and placed on top of the cabinet 110, the opening 510 matches the outlet 310 of the return air duct 305, whereas the opening 515 matches the air intake 210 of the fan 205.

As visible in FIGS. 5A, 6 and 7A, 7B, an air path for the drying air is defined in the base element 505 by means of a series of walls rising from the bottom wall. In particular, moisten-laden drying air, indicated by arrow 520 in FIG. 5A, which comes from the drum 105 and the tub 303 through the return air duct 305, and enters into the top 119 through the opening 510, initially is caused to flow essentially parallel to the left side 525 of the top 119, from the rear to the front, and to pass through an air defluff filter that is removably accommodated within a respective filter seat 530 formed in the base element 505. Upon exiting the defluff filter, the drying air passes (arrow 533) through a moisture condenser comprising an air-air heat exchanger 535, so as to be cooled down and release moisture in the form of condense water. Advantageously, the air-air heat exchanger 535 is fully accommodated within the top 119, for example, as shown, in the central part thereof.

The air-air heat exchanger 535 comprises a corrugated sheet metal part 540, the undulations of which define channels for the passage of air. The corrugated sheet metal part 540 rests, both at the front and at the rear edges thereof, on a pair of comb-like structures 705 and 710, respectively arranged along a front wall 545 of the base element 505, and along a rear wall 550 of the base element 505. When assembled, the corrugated sheet metal part 540 is joined to the base element 505, for example by means of glue in between the comb-like structures 705 and 710. When the corrugated sheet metal part 540 rests on the comb-like structures 705 and 710, the undulations define, on the underside of the sheet metal part 540, channels for the flow of the drying air 533 to be cooled down, whereas on the upper side of the sheet metal part 540 the undulations define channels for the flow of cooling air 555 that, in the embodiment here considered, is taken in from the outside environment by means of a tangential fan 560 mounted to the rear wall 550 of the base element 505. The glue used to attach the corrugated sheet metal part 540 also seals the upper and lower channels for the cooling and drying air. In this way, the drying air 533 that, after passing through the defluff filter, enters the air-air heat exchanger and flows under the corrugated sheet metal part 540, releases heat to the cooling air 555 that flows above the corrugated sheet metal part 540, and cools down, and the moisture present therein is condensed. The cooling air 555, after passing through the air-air heat exchanger, exits from the front thereof, and is then discharged into the machine cabinet 110 through an aperture 570 provided in the base element 505. In alternative to the tangential fan 560, an axial fan might be provided in correspondence of the aperture 570 for circulating the cooling air.

After passing through the air-air heat exchanger 535, the cooled drying air 573 exits therefrom at the right rear corner thereof, and then flows along a convoluted air path portion 575 to the opening 515 that is connected to the fan intake 210. Along the convoluted air path portion 575, mist/condense water droplets separation means are provided, for ensuring that mist, condense water droplets are removed from the drying air before it reaches the air fan 205.

Figure 9:
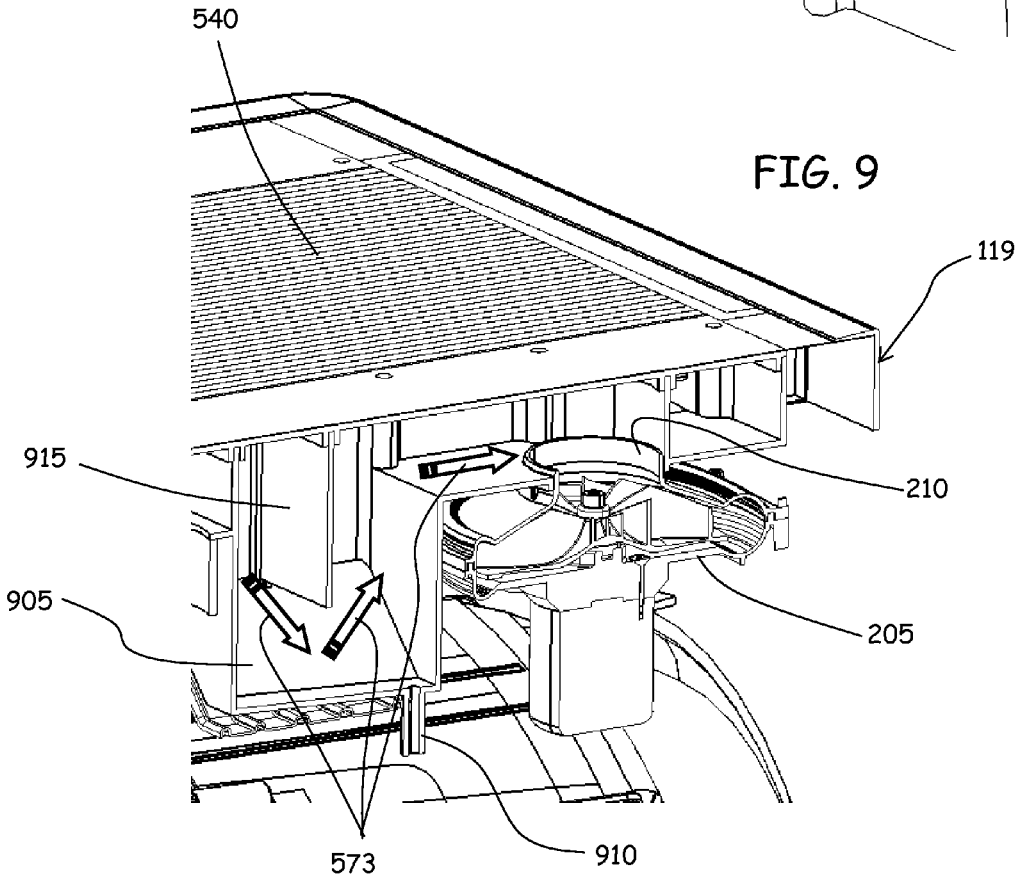
FIG. 9 shows still another detail of the worktop of FIG. 5A, particularly an embodiment of mist separation means provided in the worktop.

As visible in FIG. 9, in an embodiment of the invention, the mist/condense water droplets separation means comprises a condense water collecting tank 905 formed along the convoluted air path portion 575; droplets of condense water released by the drying air upon passing through the air-air heat exchanger are drawn by the aspiration effect of the fan 205 to the convoluted air path portion 575 and arrives at the tank 905, where they are separated from the drying air and accumulate. At the bottom of the tank 905, a condense water discharge conduit 910 is fluidly connected to the manifold 315, by means of a piping 1005, visible in FIG. 10. In particular, the piping 1005 that connects the condense water discharge conduit 910 to the manifold 315 opens into the latter at a point below the free surface of the water that remains in the siphon defined by the baffle 405; in this way, it is ensured that the condense water is not aspirated by the fan 205. When, due to the discharged condense water, the level of water in the manifold 315 raises excessively, the excess water is discharged into the tub 303, in a position thereof such that the water does not enter the drum, but is instead directly conveyed, via the tub, to a liquid discharge circuit, comprising a water discharge pump (not shown), provided in the washer/dryer.

As an alternative to discharging the condense water into the manifold 315, the condense water that accumulates in the tank 905 may be directly conveyed (through a piping not shown) to the water discharge pump of the machine.

Figure 11:
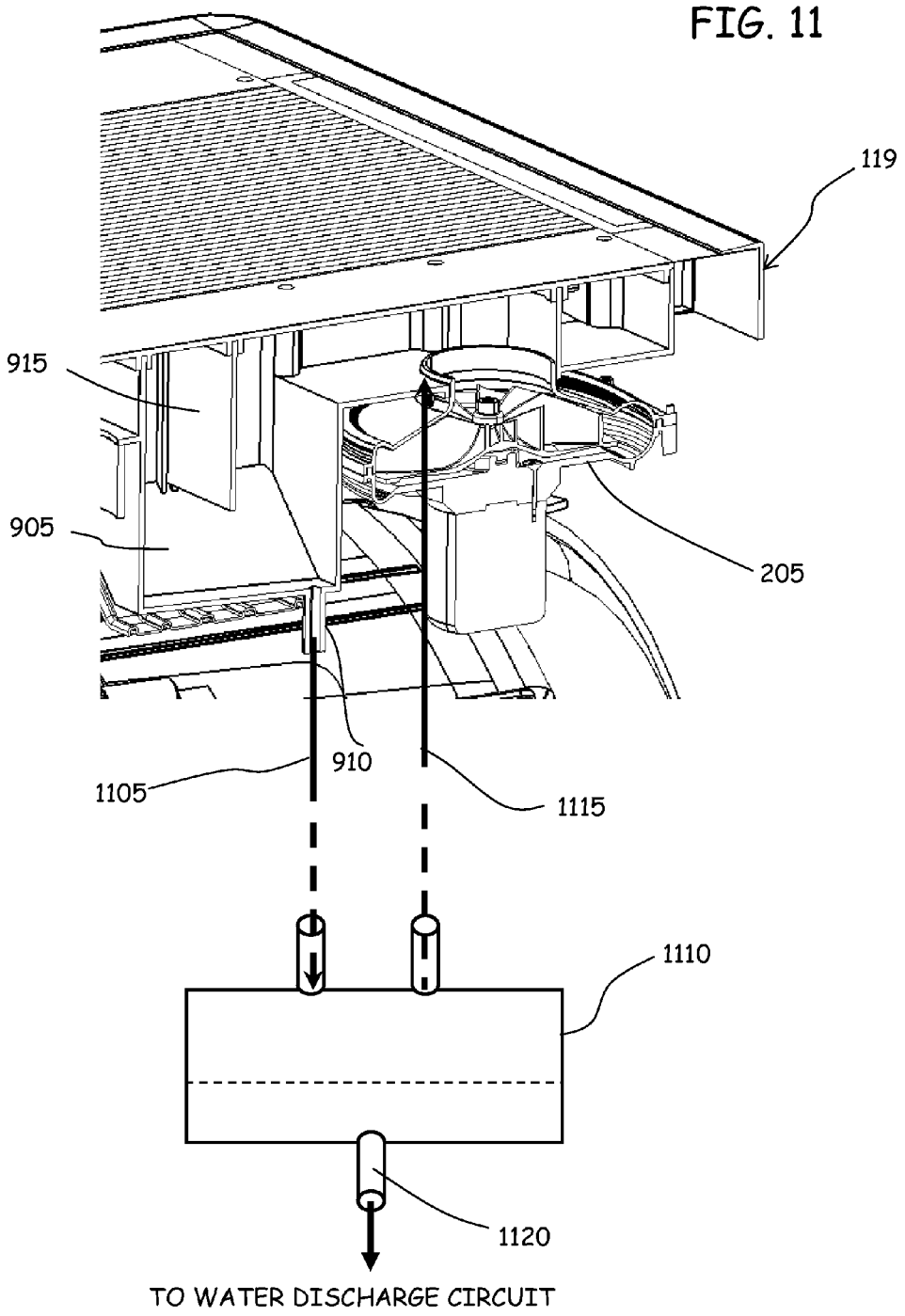
FIG. 11 schematically shows a detail of an alternative embodiment of the mist separation means of FIG. 9.
Figure 17:
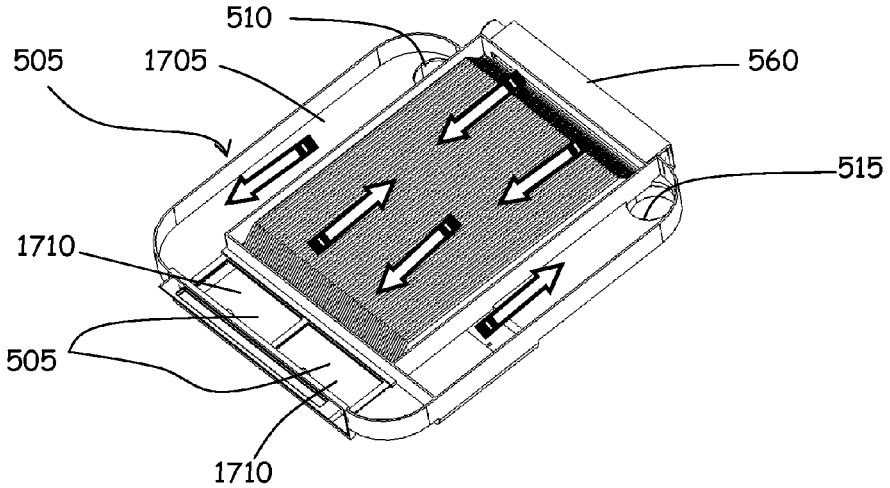
FIGS. 17 and 18 show an alternative construction of the worktop of FIG. 5A.
Figure 18:
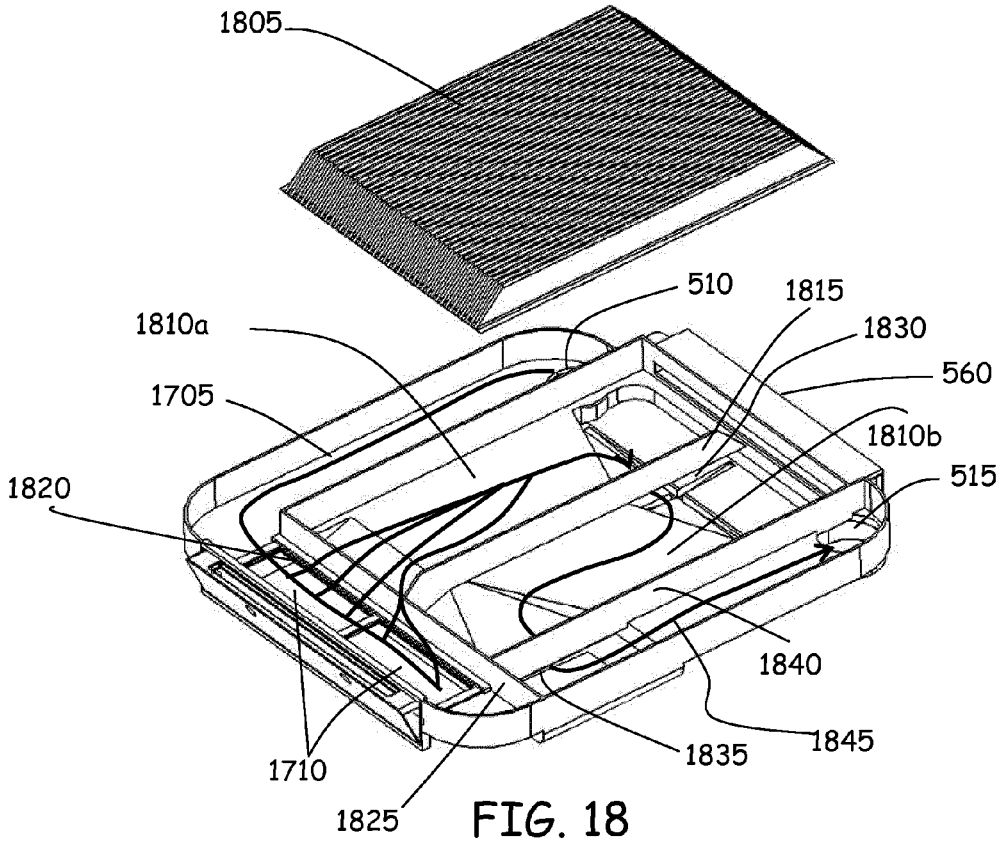

Preferably, as schematically depicted in FIG. 11, in order to avoid that the depression generated by the fan 205 may suck condense water that deposits in the tank 905, the discharge conduit 910 of the tank 905 is fluidly connected, by a conduit 1105, to a lower tank 1110, located at a suitable lower quota with respect to the top 119, for example at or near the basement of the washer/dryer. The lower tank 1110 is further fluidly connected, through a conduit 1115, to a point of the convoluted air path portion 575 located downstream the tank 905, for example close to the air intake 210 of the fan 205. The bottom of the lower tank 1110 has a condense water discharge outlet 1120 that is fluidly connected to the water discharge circuit of the washer/dryer, and thus to the discharge pump.

A baffle 915 is preferably provided in the tank 905, the baffle 915 defining a siphon; the presence of the baffle 915, forming a barrier for the drying air flow, facilitates that water droplets that are transported by the flow of drying air fall into the tank 905, preventing them from reaching the fan 205.

As an alternative to the provision of the baffle 915 shown in FIGS. 9 and 11, a mist separator element 1205 may be accommodated in the tank 905, as depicted in FIG. 12, for promoting the removal of moist droplets from the drying air. The mist separator element 1205 may for example be formed of a plurality of metal or plastic plates bent to define a winding path. Also in this case, the lower tank 1110 may be provided.

Figure 7A:
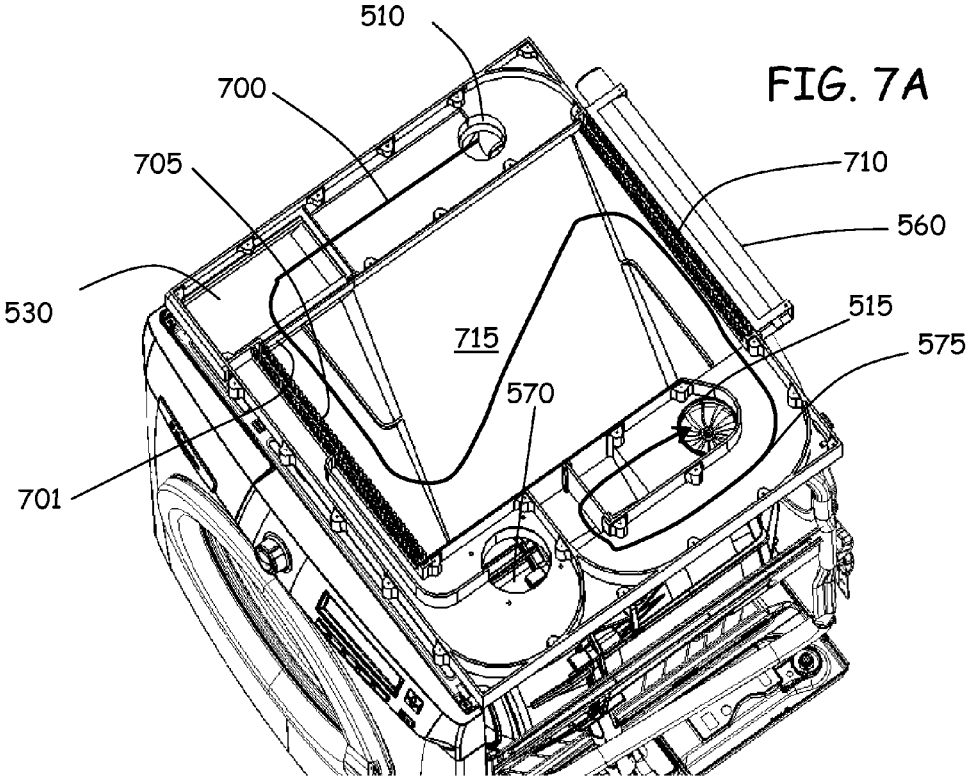
FIGS. 7A and 7B schematizes the path followed, within the worktop of FIG. 5A, by laundry drying air to be dehydrated, and by cooling air used to cool down the drying air so as to remove moisture therefrom.
Figure 7B:
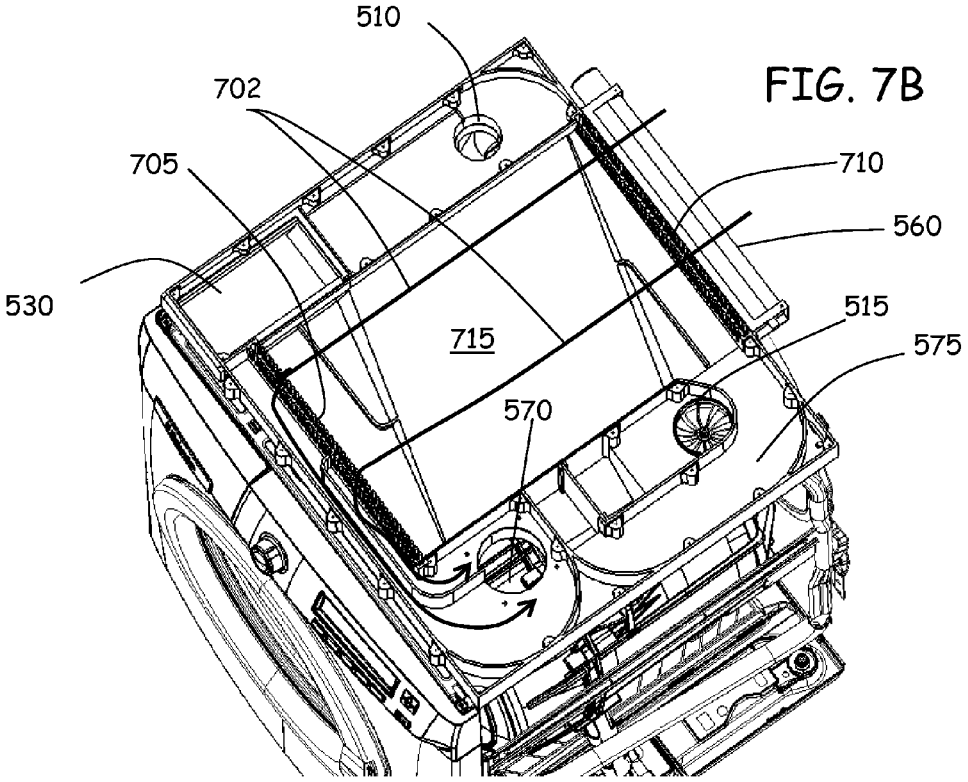
Figure 8:
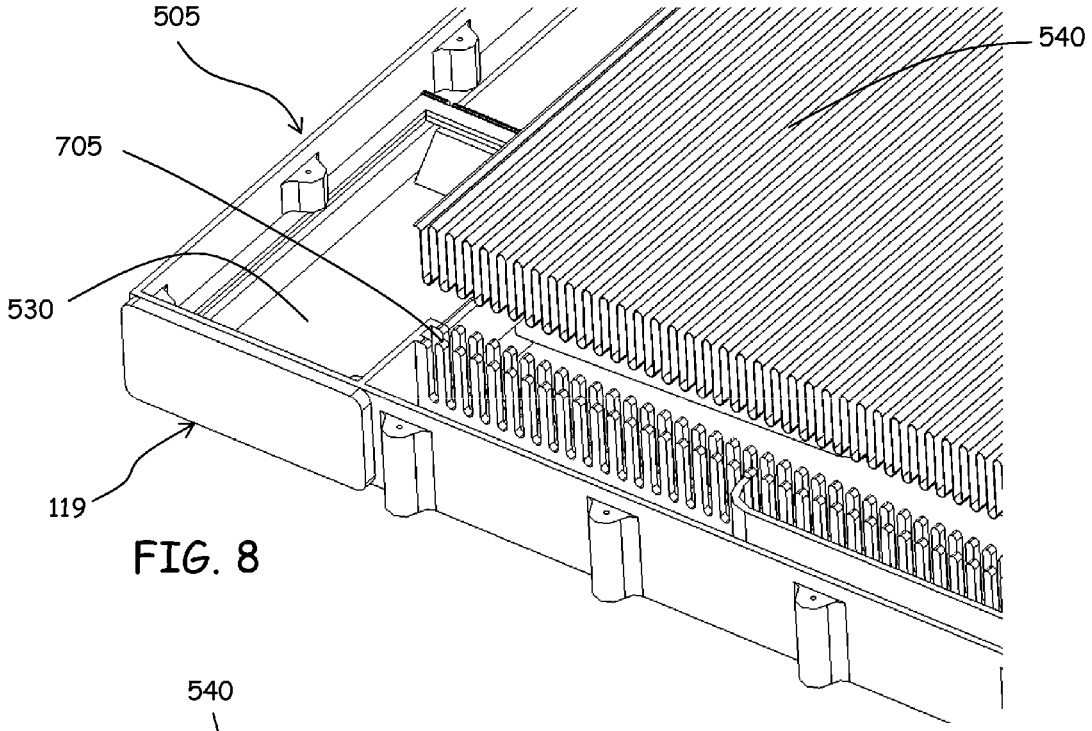
FIG. 8 shows another detail of the worktop of FIG. 5A.

The path followed in the top 119 by the moisten-laden drying air is also schematized in FIG. 7A, and indicated therein as 700. The drying air passes through the defluff filter vertically, from the top to the bottom filter surfaces, and exits the filter seat 530 (for then entering into the air-air heat exchanger) passing through an opening 701 formed along a bottom of a side wall of the filter seat 530. In FIG. 7B, there is instead schematized (reference 701) the path followed by the cooling air.

The condense water that accumulates in the tank 905 may be exploited for generating steam used for refreshing the items to be dried during the drying cycle. As schematized in FIGS. 13 and 14A, the tank 905 may be shaped so as to have a deeper portion 1305, defining a reservoir for water used to generate steam. A pump 1310 has an inlet connected to the tank deeper portion 1305; the pump 1310 has an outlet fluidly connected to a nozzle 1405 arranged to spray inside the air duct 215, preferably in a point thereof where there is the electrical resistor provided for heating the drying air; in this way, the heat generated by the resistor cause the water sprayed by the pump 1305 to vaporize, and steam is generated that is useful for refreshing the items being dried. The resistor may be mounted internally or externally to the air duct 215; in case the resistor is mounted within the air duct 215, an armoured resistor should be used. For a more efficient operation, as depicted in FIG. 15, the drying air heating resistor 1505 may be associated with a heat dissipater/radiator 1510 having fins, that is accommodated within the air duct 215. In this way, the effect of drying air heating and of vaporisation of the water sprayed by the pump 1310 is enhanced.

Figure 14B:
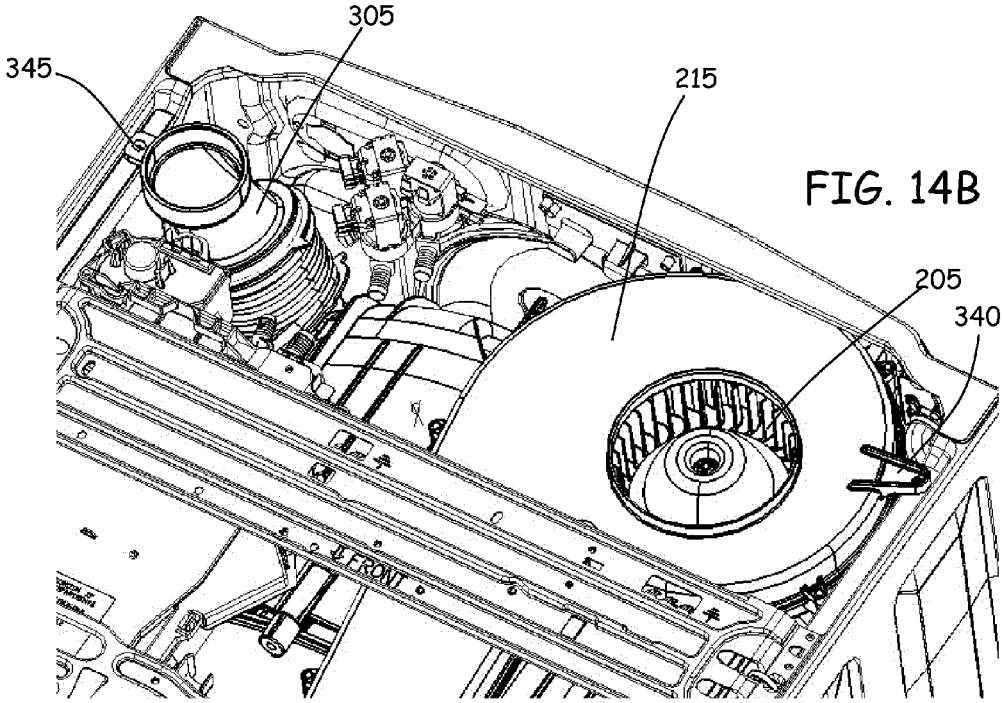
FIG. 14B shows a detail of the fixation of the drying air circulation fan of FIG. 14A to the machine cabinet.

In FIGS. 14A and 14B there is also shown a variant of the construction of the fan 205 and air duct 215, in which the air duct 215 is shaped so as to also define a shell forming a housing for the fan 205, particularly for the fan rotor 1410; the air duct is made of two half-shells, and is fixedly, rigidly mounted to the cabinet 110 by means of the bracket 340, as visible in FIG. 14B.

Referring back to FIG. 5A, a pair of panels 580 and 585 are provided in the top 119 for closing from above the air path for the drying air defined in the base element 505. The top 119 is completed by a further panel 590, having also aesthetic function, that is superimposed to the two panels 580 and 585 and that also covers the corrugated sheet metal plate 540, and by a frame 595 (the panel 590 and the frame 595 are not depicted in FIG. 2). The panels 580, 585 and 590 are secured to the base element 505 for example by means of screws. Acoustic absorbing material can be inserted in the top 119, for example between the panels 580, 585 and the panel 590.

Figure 16:
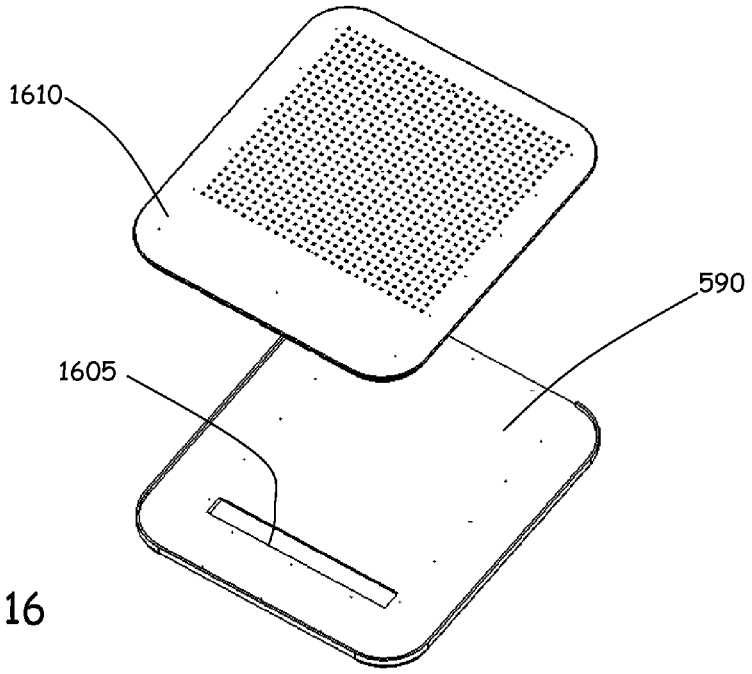
FIG. 16 shows schematically an embodiment of the worktop of FIG. 5A adapted to define a drying surface for laying garments to be dried gently.
Figure 5B:
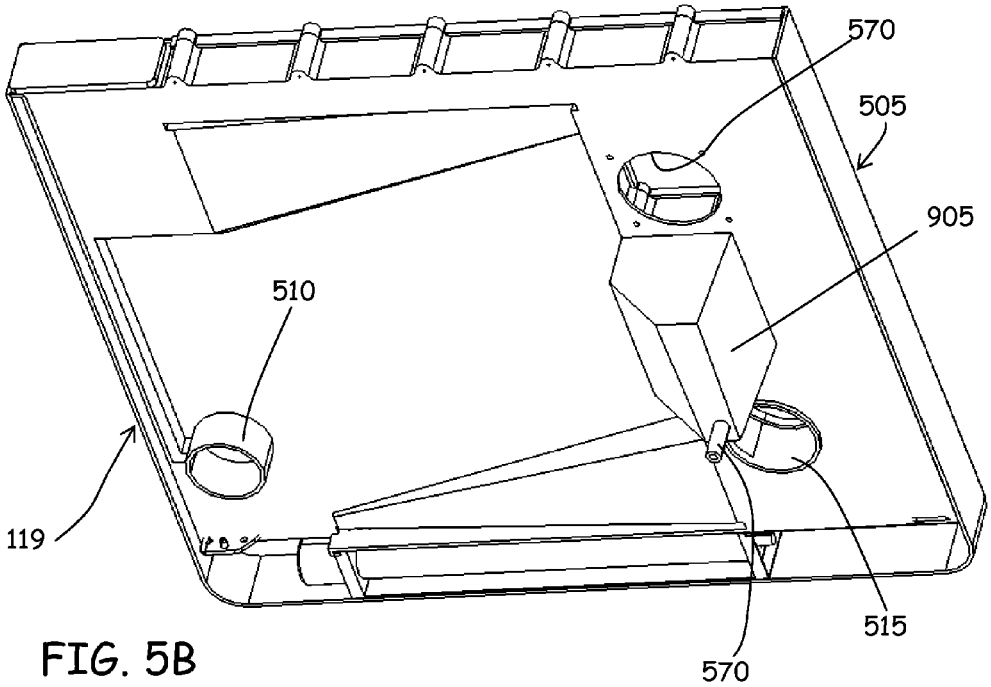
FIG. 5B shows the worktop of FIG. 5A from below.

In an embodiment of the present invention, shown in FIG. 16 (and similarly in FIGS. 19 and 20, although the latter drawings relate to a variant of the top here described, that will be described later on), the panel 590 has an elongated aperture 1605 extending parallel to the front of the top 119, from which opening 1605 the cooling air 555, after having passed through the air-air heat exchanger 535, exits. Above the panel 590, a perforated panel 1610 rests, slightly spaced apart from the panel 590, so as to leave an air gap between the two panels 590 and 1610. The cooling air 555, heated by the heat released by the drying air 533, exits from the perforations in the panel 1610. In this way, the top 119 may be exploited for laying thereon delicate garments to be dried that, due to their nature, cannot be dried within the tumbling drum without being damaged. The top 119 thus defines thereinside a path for the drying air to be cooled down, and another path for the cooling air which is also exploited for drying delicate garments by laying them on the perforated surface of the panel 1610.

The top 119, once assembled, forms a unit that is ready to be mounted to the cabinet 110, simply by placing it in the correct alignment, so that the openings 510 and 515 matches the outlet 310 of the return air duct 305 and, respectively, the intake 210 of the air circulation fan 205. As mentioned in the foregoing, both the return air duct 305 and the fan 205 are fixed, rigidly connected to the machine cabinet 110; in this way, the outlet 310 of the return air duct 305 and the air intake 210 of the air circulation fan 205 act as automatic positioning and centering means for the top 119, thereby greatly simplifying the mounting thereof. The operation of mounting of the top onto the cabinet simply consists in laying the top 119 on the cabinet properly positioning it with the help of the self-centering action achieved by the matching of the openings 510 and 515 with the outlet 310 and air intake 210; in this way, all the necessary connections for the drying air circulation circuit are completed, and there is no need to perform any additional connection (exception made for the connection of the condense water discharge piping 1005). The top 119 may then be secured to the cabinet 110 by conventional means (e.g., screws, or by snap-fit engagement). Thanks to the fact that several components of the drying air circulation system, particularly the moisture condensing system, are accommodated within the top 119, several problems of space within the cabinet 110 are overcome; essentially, only the fan 205, the air duct 215, and the return air duct 305 need to be accommodated within the cabinet 110. This reduces problems of space within the cabinet 110, and makes it easier to exploit an already existing design of a washing machine to transform it into a washer/dryer, without having to make substantial changes.

Figure 19:
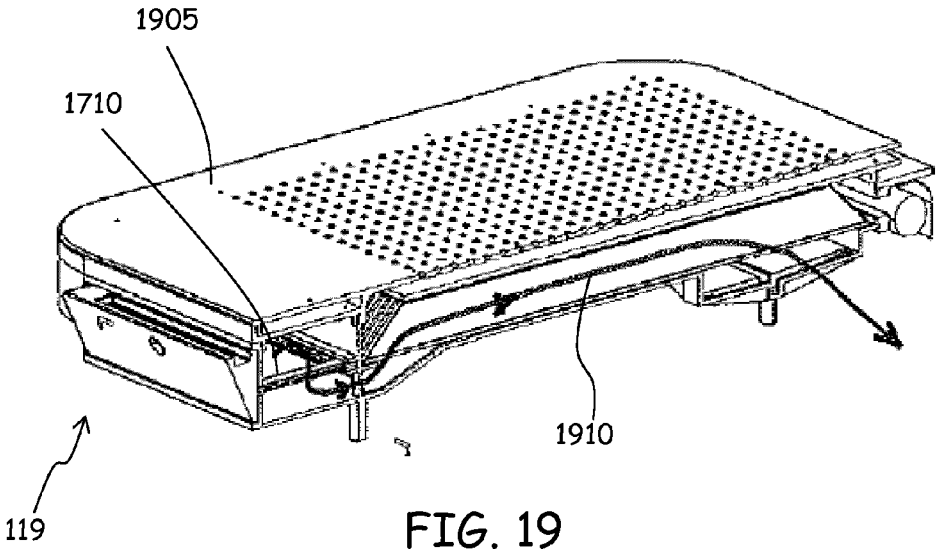
FIGS. 19 and 20 show the implementation of the concept of FIG. 16 to the alternative worktop construction of FIGS. 17 and 18.
Figure 20:
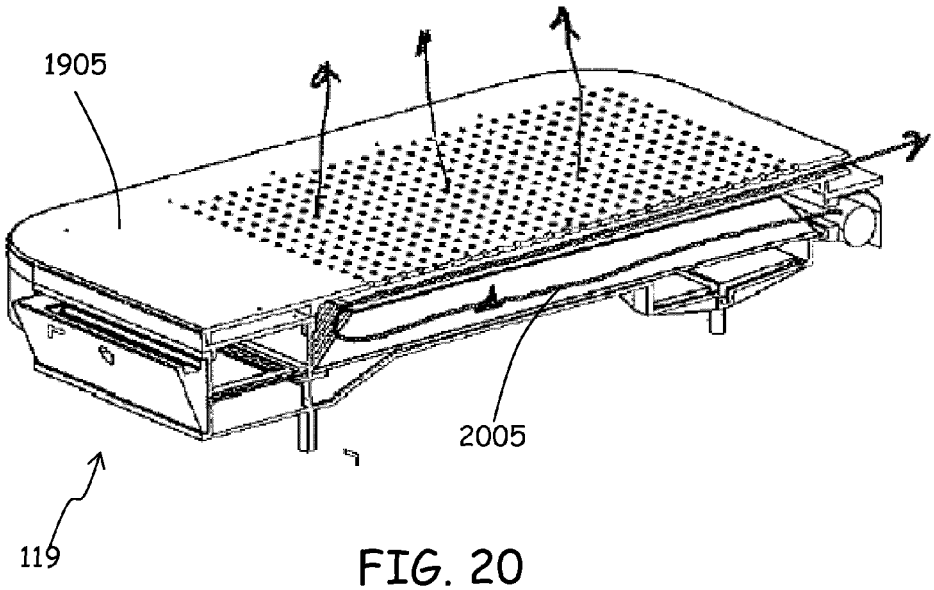
Figure 21:
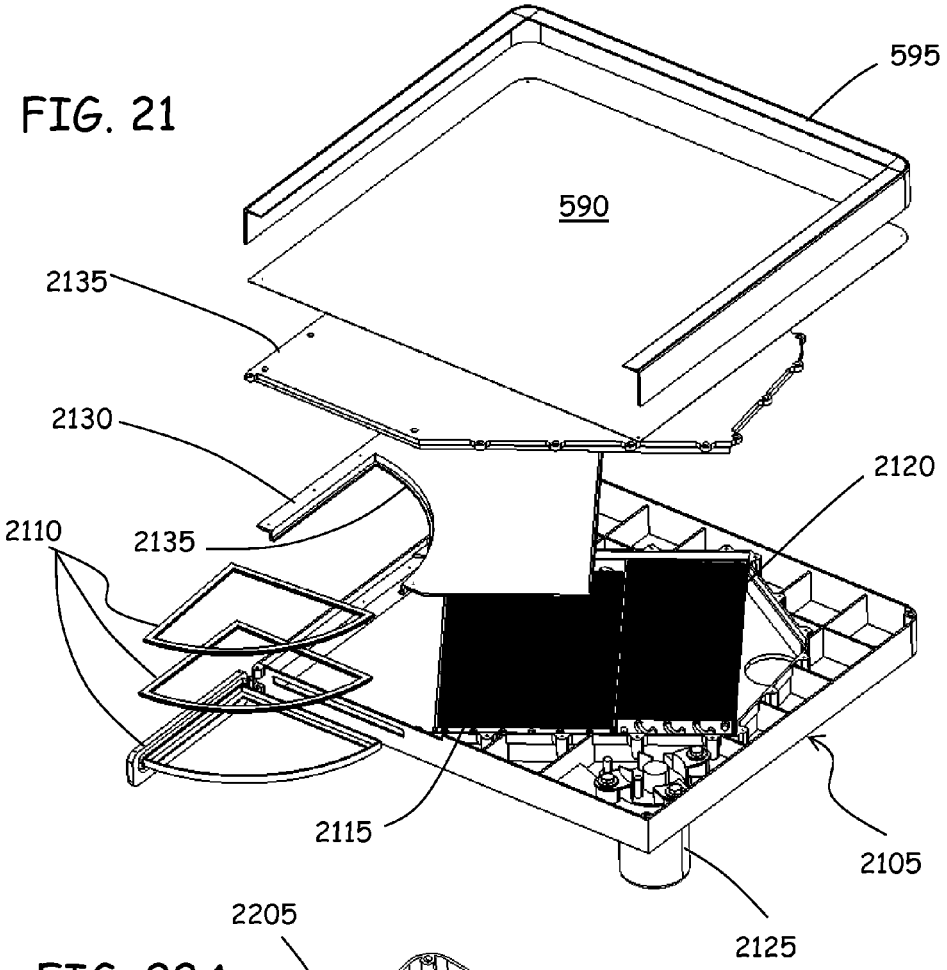
FIG. 21 shows in exploded view a worktop according to another embodiment of the present invention, comprising a heat pump for dehydrating and then heating the drying air.
Figure 22A:
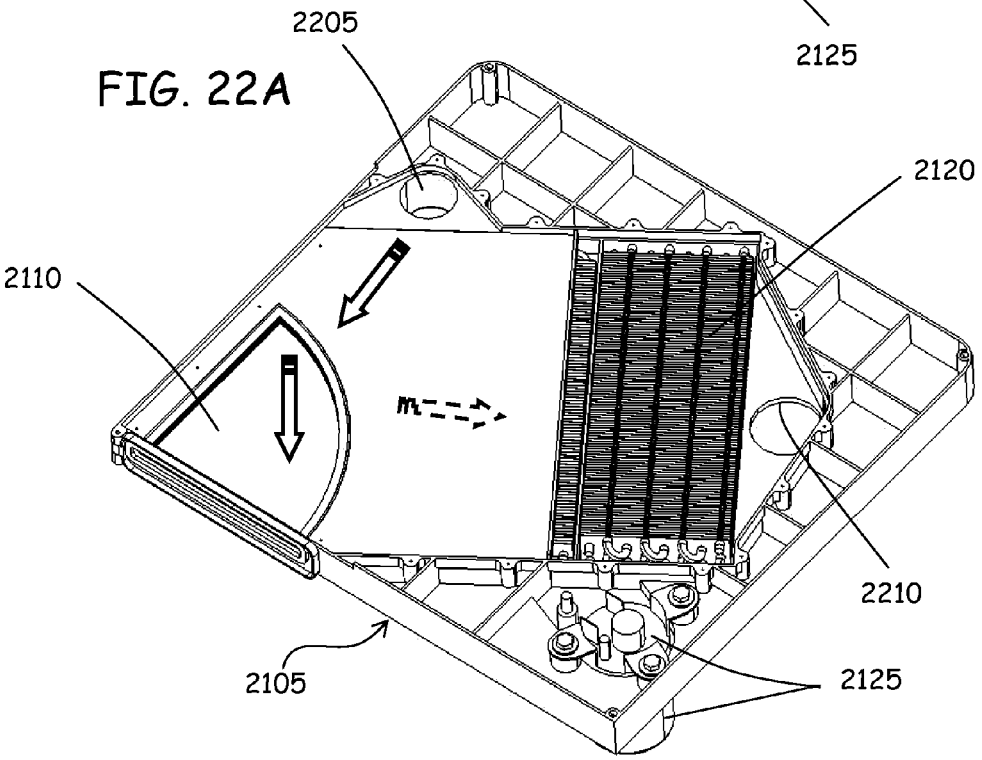
FIG. 22A shows the worktop of FIG. 21 partially mounted, and schematizes the path followed by the drying air.
Figure 22B:
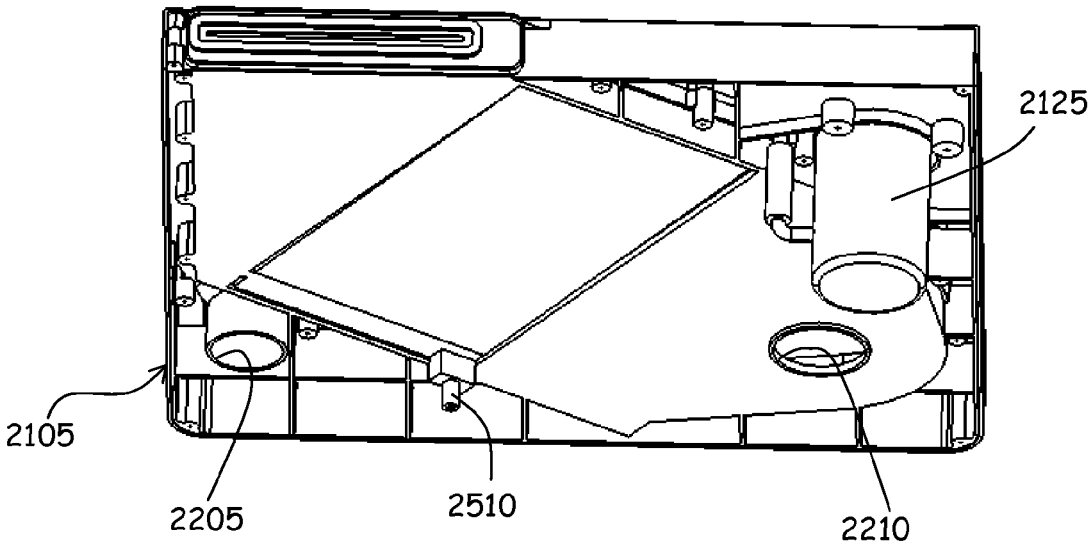
FIG. 22B shows the worktop of FIG. 22A from below.
Figure 24B:
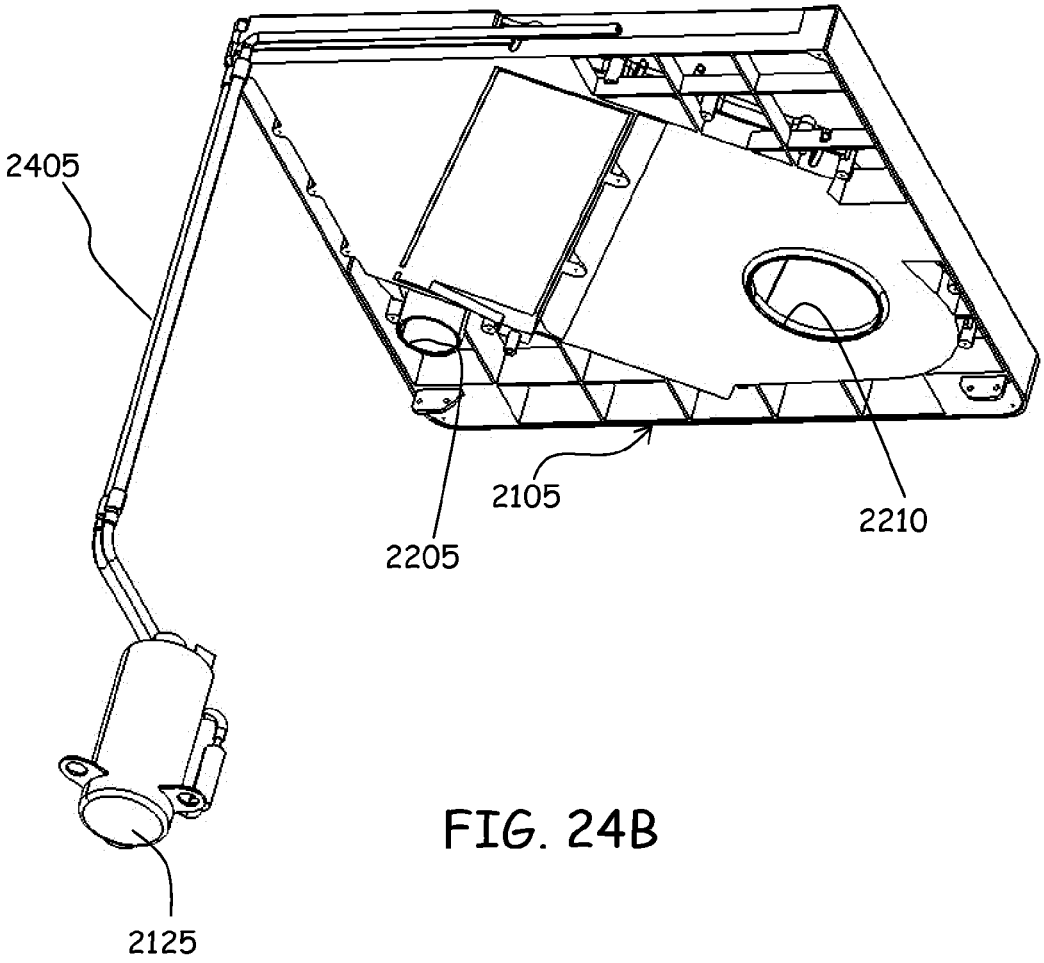
FIG. 24B shows from below the worktop and compressor in the variant of FIG. 24A.
Figure 23:
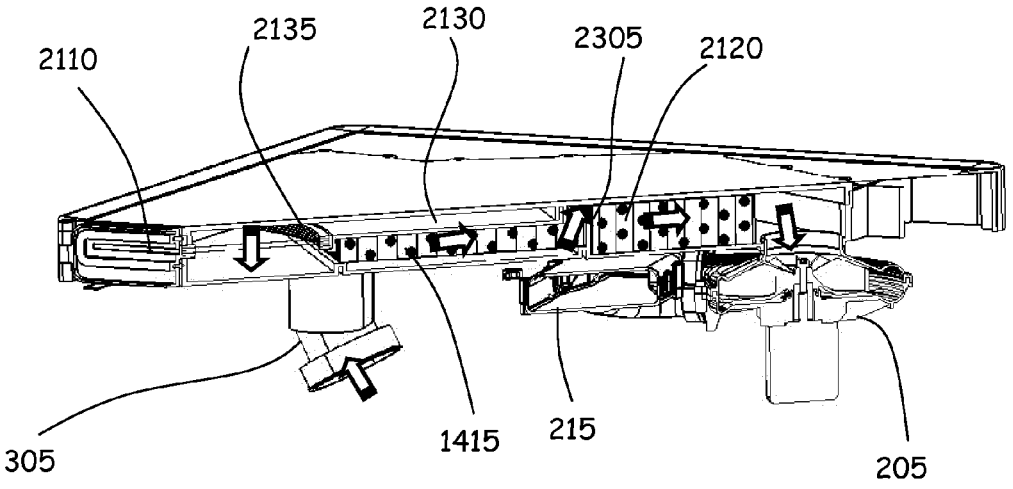
FIG. 23 shows the worktop of FIG. 21 partially sectioned, and also schematizes the path followed by the drying air.
Figure 24A:
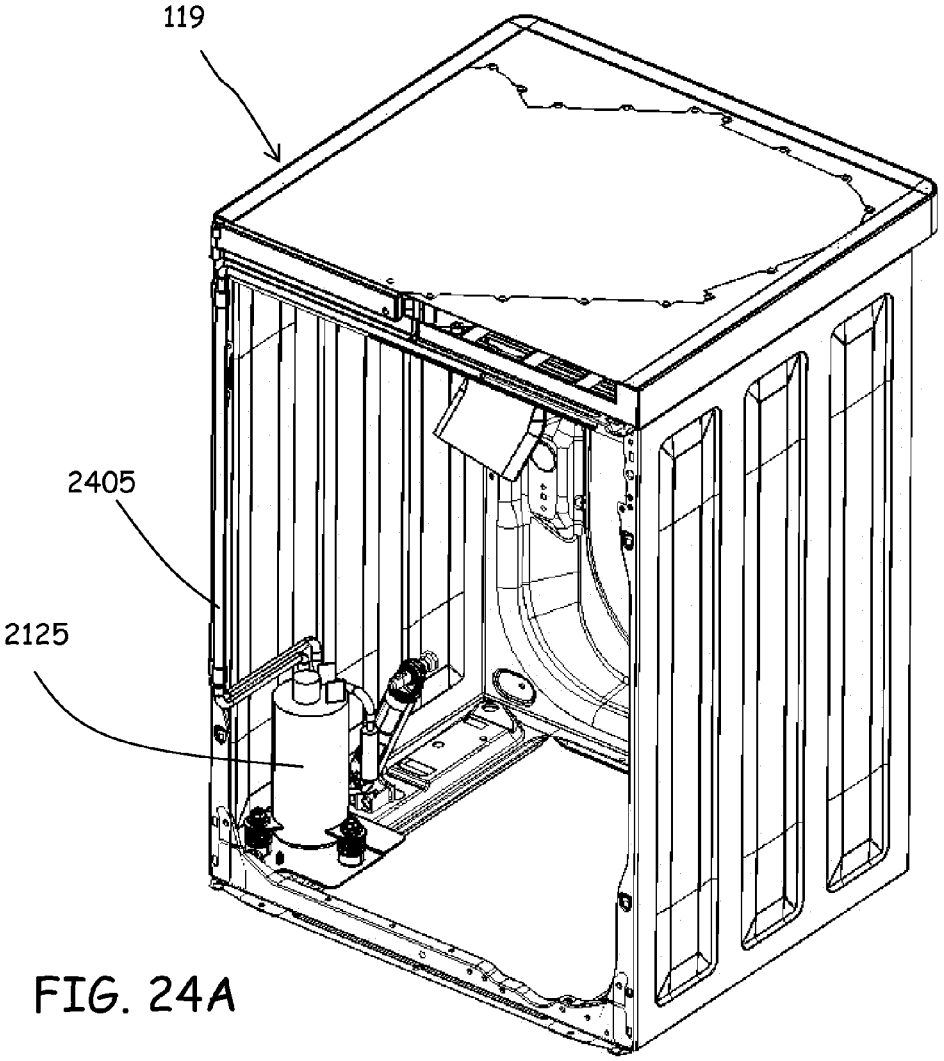
FIG. 24A shows a variant of the solution of FIG. 22, with a compressor accommodated in the basement of the machine.

A top 119 according to a variant of the embodiment just described is depicted in FIGS. 17-20. In this case, the drying air to be cooled down for releasing the moisture and be dehydrated passes through the air-air heat exchanger twice, once going from the front towards the rear, and then back towards the front, as schematized in FIG. 18. This double passage improves the action of cooling of the drying air by the cooling air, and thus improves the release of moisture. In particular, the drying air, entering into the top 119 through the opening 510, flows along a substantially rectilinear path 1705 defined in the base element along the left side thereof, from the back to the front, and then enters a defluff filter 1710, which in this alternative is accommodated along the front side of the base element 505. The drying air passes through the defluff filter (from the top to the bottom thereof), and then enters the air-air heat exchanger. As in the previously described embodiment, the air-air heat exchanger comprises a corrugated sheet metal part 1805, the undulations defining channels for the passage of the drying air (under the corrugated sheet metal part 1805) and for the cooling air (above the corrugated sheet metal part 1805). The region of the base element 505 intended to accommodate the corrugated sheet metal part 1805 is divided in two parts 1810*a*, 1810*b*, separated by a wall 1815 extending parallel to the side walls of the base element 505. The drying air passes from the filter to the air-air heat exchanger flowing through a passage 1820 formed at the bottom of a wall 1825 that separates the filter lodging from the region of the air-air heat exchanger, said passage being located on the left side of the base element. The drying air flows under the corrugated sheet metal part 1805 in the first part 1810*a* of the base element 505, then, at the rear of the base element 505, the drying air passes to the second part 1810*b* of the base element passing through a passage 1830 formed at the bottom of the wall 1815. The drying air then flows under the corrugated sheet metal part 1805 in the second part 1810*b* of the base element 505 to the front, and exits the air-air heat exchanger passing through an aperture 1835 below a lateral wall 1840 of the base element 505 that delimits the region thereof accommodating the corrugated sheet metal part 1805. The cooled drying air thus exits the air-air heat exchanger from the front-right corner thereof, then the drying air flows along an essentially straight air path 1845 towards the opening 515, where there is the intake 210 of the fan 205. For the discharge of the condense water that is released by the drying air, solutions similar to those described above are exploitable. As shown in FIGS. 19 and 20, the top panel 1905 of the top 119 may also in this case be perforated, for the passage of the cooling air, so as to provide a working surface for lying delicate garments that are not suitable to be dried by putting them into the tumbling drum of the machine. The top 119 defines thereinside a path for the drying air 1910 to be cooled down, and another path for the cooling air 2005 which is also exploited for drying delicate garments by laying them on the perforated surface of the panel 1905.

FIGS. 21 to 26 show, in different views, a solution according to another embodiment of the present invention, in which the condensing system is almost completely accommodated within the top 119 and comprises, as mentioned in the foregoing, a heat pump, instead of an air-air heat exchanger.

Also in this case, the top 119 comprises a base element 2105, which has two openings 2205 and 2210 formed in its bottom wall, the former opening 2205 being located in correspondence of the outlet 310 of the return air duct 305, the latter opening 2210 being located in correspondence of the intake 210 of the fan 205. In the region of the base element 2105 near the front-left corner thereof, a defluff filter arrangement 2110 is located, for example in the form of a drawer hinged at one end to the base element 2105 and pivotable so as to allow its extraction for cleaning purposes. The defluff filter may comprises a pair of superimposed meshes that can be separated for being cleaned.

A moisture condensing system is accommodated in the central region of the base element 2105, the moisture condensing system includes a heat pump circuit comprising a first heat exchanger 2115, for cooling and dehydrating the moisture-laden drying air, and a second heat exchanger 2120, downstream the first heat exchanger 2115, for heating the drying air. Depending on the refrigerating fluid used in the heat pump, the first heat exchanger 2115 may be an evaporator or a gas heater (the latter, in case the refrigerant operates at supercritical pressure), and the second heat exchanger 2120 may be a condenser or a gas cooler (the latter in case the refrigerant operates at supercritical pressure); in the following it will be assumed that the heat pump comprises an evaportator and a condenser, but this is not to be construed as a limitation. The evaporator 2115 has the function of dehydrating the drying air, by cooling it down; the condenser 2120 has instead the function of heating the dehydrated drying air. A compressor 2125 for the heat pump is attached to the underside of the base element 1405 in correspondence of the front-right corner thereof, the compressor body protruding from below the base element 2105. In an alternative embodiment, shown in FIGS. 24A and 24B, the compressor 2125 may be located at the bottom of the cabinet 110, attached to the machine basement, and be fluidly connected to the moisture condensing system accommodated in the top 119 by means of flexible pipes 2405 than run along a rear corner of the cabinet 110.

The compressor may be a variable-speed compressor, allowing to trade off required power and available space.

The base element 2105 is covered by a first panel 2130, that covers essentially just the evaporator 2115, and a second panel 2135, that also covers the condenser 2120 and the filter 2110. The top 119 is completed by the top panel 590 and the frame 595. Acoustic absorbing material can be inserted in the top 119, for example between the panels 2135 and 590.

The base element 2105 and the two panels 2115 and 2135 define a first air path that conveys the drying air coming from the return air duct 305 to the defluff filter, preventing the drying air from entering the evaporator, and a second air path that, from the defluff filter, goes to the condenser passing through the evaporator.

The drying air passes through the filter 2110 from the top to the bottom of it, and then enters the evaporator 2115. The panel 2130 has, along an edge thereof that runs along the border between the filter 210 region and the evaporator 2115 region, a downwardly projecting lip 2135 that prevents the drying air to enter the evaporator region from above the filter 2110.

In the region of the base element 2105 under the evaporator 2115, there are provided mist/condense water droplets separation means; in particular, the base element 2105 is slanted towards a baffle 2305 that separates the area of the base element 2105 where the evaporator 2115 is accommodated, from the area where the condenser 2120 is placed. The baffle 2305 forms a barrier for the condense water that drops from the drying air when it passes through the evaporator 2115. Preferably, transversal channels 2505 are formed in the bottom wall of the base element 2105 in the area corresponding to the evaporator 2115, to facilitate the drainage of the condense water. A condense water drainage hole 2510 is formed in the area of the base element bottom wall corresponding to the evaporator 2115; the drainage hole 2510 is fluidly connected, through a conduit 2605, to the manifold 315, for discharging the condense water. The conduit 2605 opens into the manifold 315 at a point below the surface of the water that remains in the manifold 315, for avoiding that, due to the depression created by the fan 205, the condense water is aspirated back. Also in this case, the excess condense water that accumulates in the manifold 315 discharges into the tub, in a manner such as not to enter into the drum, and then goes to the water discharge circuit of the machine. Alternatively the drainage hole 2510 may be fluidly connected to the water discharge circuit (e.g., to the discharge pump) directly.

Also in this second embodiment, the top 119, once assembled, forms a unit that is ready to be mounted to the cabinet 110, simply by placing it in the correct alignment, so that the openings 2205 and 2210 matches the outlet 310 of the return air duct 305 and, respectively, the intake 210 of the fan 205. The top 119 may then be secured to the cabinet 110 by conventional means (e.g., screws or snap-fit engagement). No further connections need to be made, exception made for the connection of the drainage hole 2510 to the manifold 315; in the variant having the compressor located in the basement, the top 119 may be preassembled with the pipes 2405 attached to the heat pump; after placing the top on the cabinet, the pipes 2405 are connected to the compressor.

The solution exploiting an air-air-heat exchanger as a condensing means for removing moisture from the drying air achieves a significant saving of water compared to the solutions known in the art exploiting a water spray condenser; in fact, water spray condensers waste several liters of waters, that is taken in from the water main.

The solution exploiting the heat pump, in addition to achieving a saving of water as that exploiting the air-air-heat exchanger, also allows saving electrical energy, because the electrical resistor for heating the drying air may be dispensed for (the heating of the drying air being carried out by the condenser); in any case, nothing prevents from providing also in this embodiment the resistor air heater: for example, it may be useful for the starting phases of the drying cycle, when the condenser in the heat pump has not yet reached the full working temperature, or for the generation of steam for refreshing the items being dried, as in the solution described above.

Figure 27:
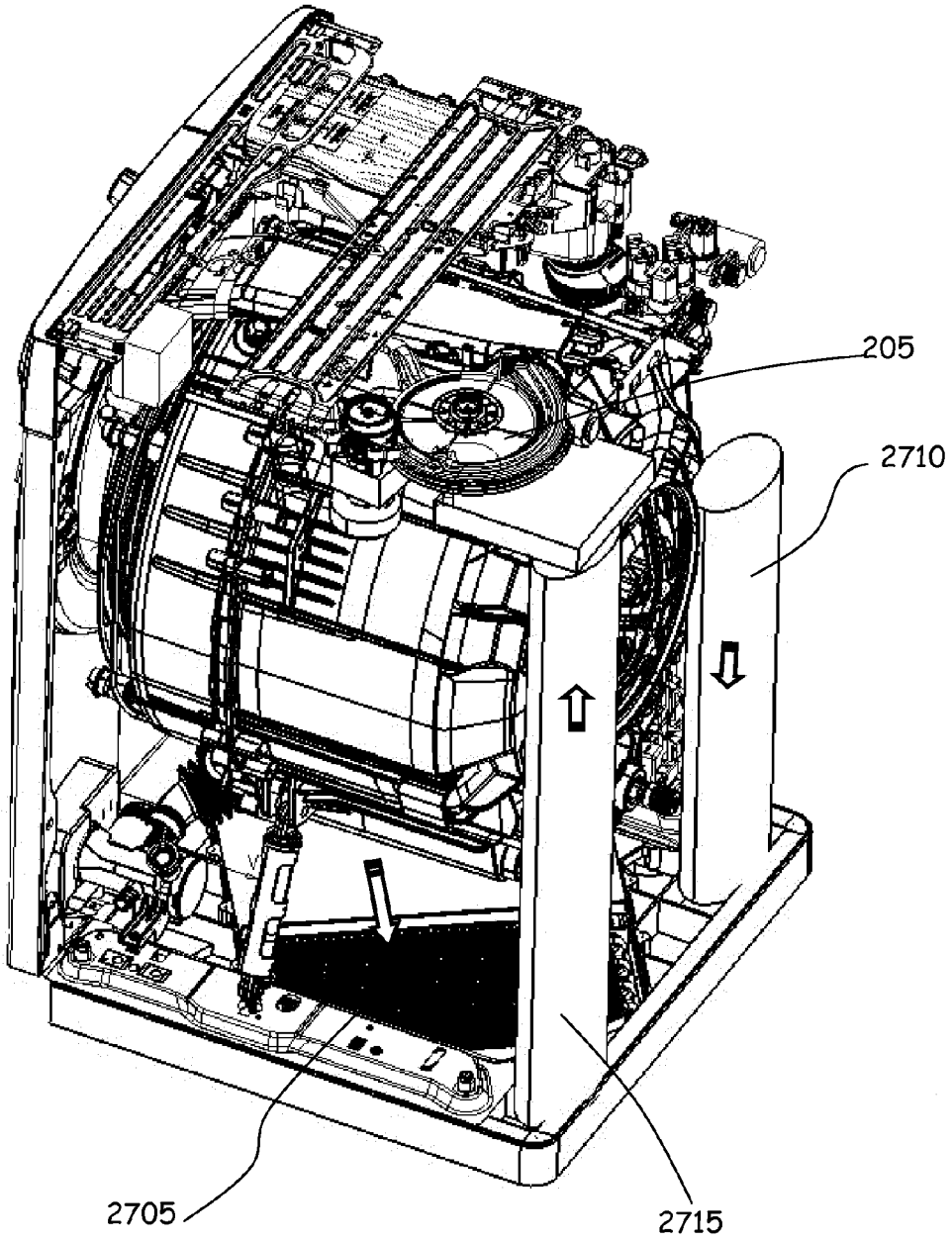
FIG. 27 shows a variant of the solution of FIGS. 21 to 26, with the heat pump accommodated in the basement of the appliance.

In FIG. 27 there is shown a variant of the heat pump solution in which the heat pump 2705, instead of being accommodated within the top 119, is placed at the base of the cabinet (the compressor being in this accommodated at the bottom of the machine); air ducts 2710 and 2715 extending along the rear wall of the cabinet are provided for conveying the drying air exiting the drum to the heat pump, and for conveying back the demoisturized drying air to an air intake of the air circulation fan 205. Also in this case, the heat pump may be realized in the form of an assembly ready to be mounted.

Several modifications to the embodiments described in the foregoing can be envisaged.

For example, the rotary defluff filter described in connection with the second embodiment could be implemented as well in the first embodiment.

Figure 28:
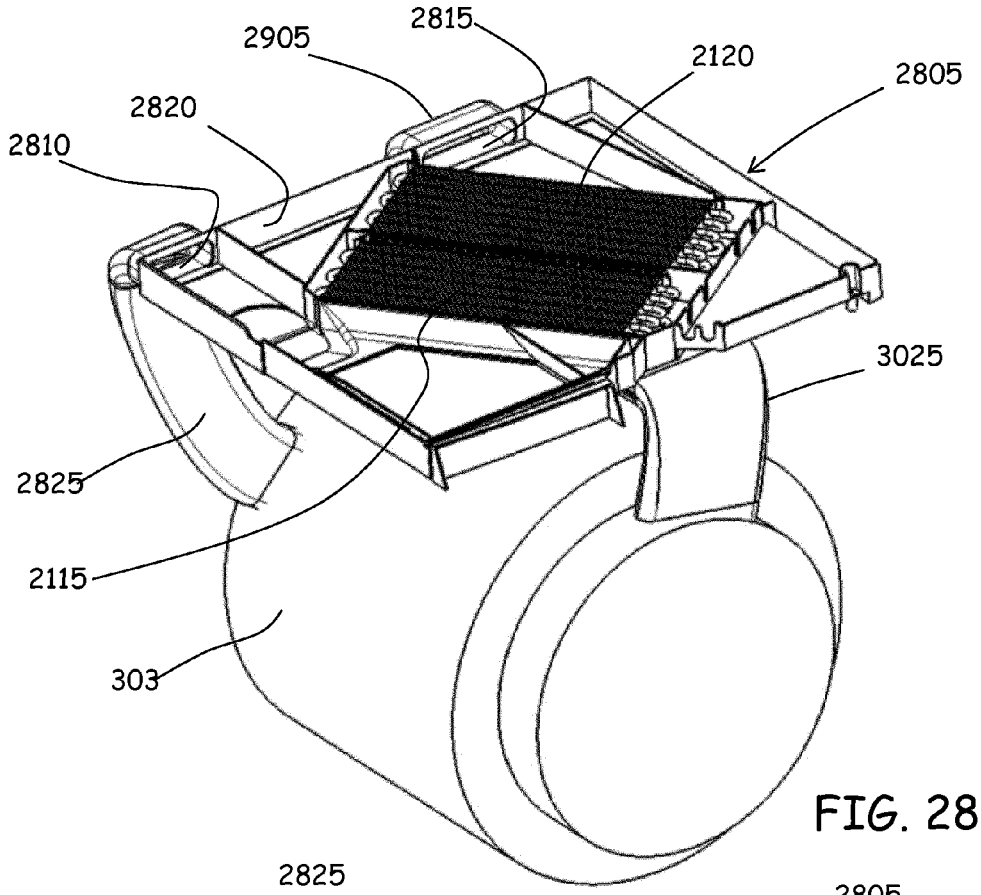
FIGS. 28-30 show in perspective and also in exploded views a worktop according to another embodiment of the present invention.
Figure 29:
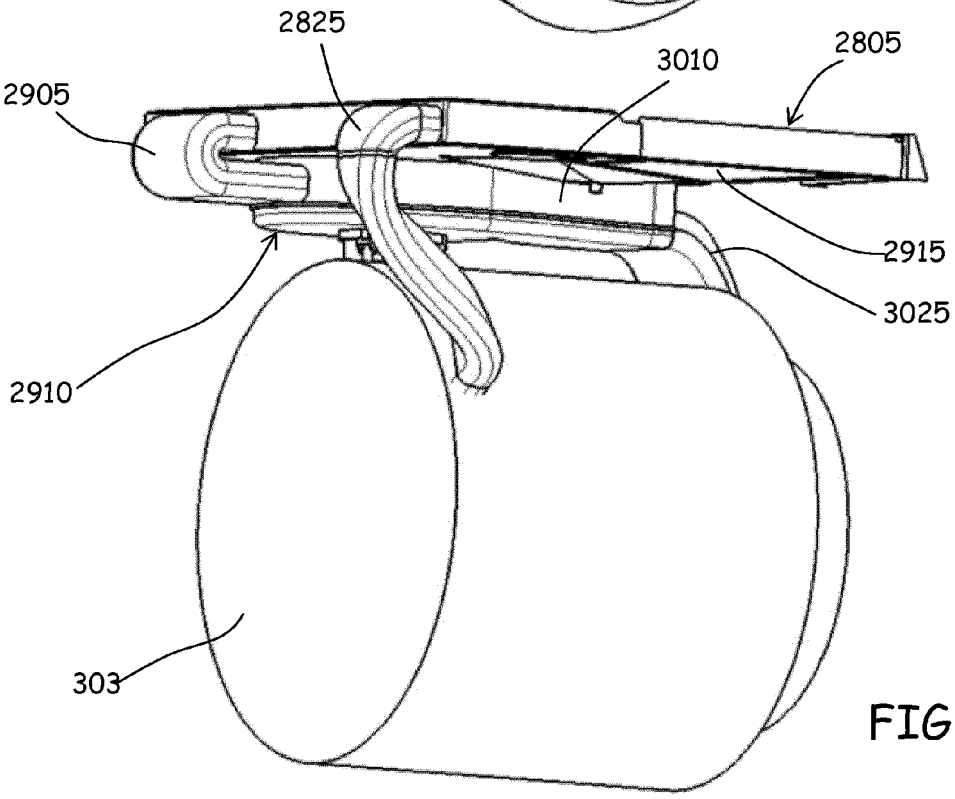
Figure 30:
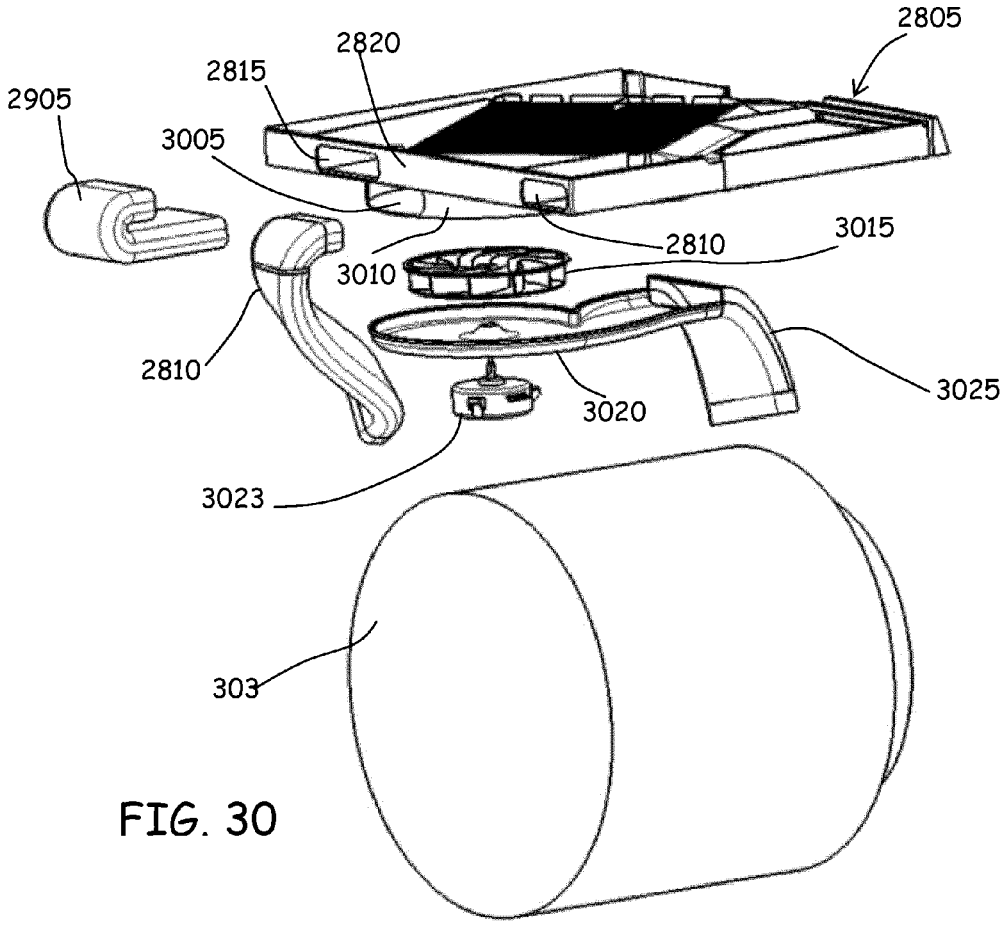

In FIGS. 28-30 another embodiment of the present invention is depicted. In this embodiment, instead of having the two openings 510 and 515 formed in the bottom wall of the top base element 505 like in the embodiment of FIGS. 1-20, or the two openings 2205 and 2210 formed in the bottom wall of the top base element 2105 like in the embodiment of FIGS. 21-27, which openings 510 and 515, 2205 and 2210 match the outlet 310 of the return air duct 305 and, respectively, the air intake 210 of the fan 205, the top 119 has a base element 2805 in which two openings 2810 and 2815 are formed in a rear wall 2820 of a frame that surrounds the bottom wall of the top base element 2805. To the opening 2810, an end of a flexible hose 2825 is connected, which hose 2825, at the other end, is connected to an opening in the tub 303, which may for example be the opening provided for feeding the laundry washing treatment products, or the hose 2825 may be connected to the manifold 315, like the return air duct 305 in the previously described embodiments. The opening 2815 is connected, through a flexible hose 2905, to an air intake 3005 of a fan 2910. Differently from the previously described embodiments, the fan air intake 3005 is formed at the rear of a fan housing 3010. It is underlined that even if FIGS. 28-30 relate to a moisture condensing system implemented by a heat pump, nothing prevents from adopting this same arrangement of openings 2810 and 2815 at the back of the base element 2805 also in connection with a moisture condensing system comprising an air-air heat exchanger. Also, nothing prevents that the hose 2825 is connected to the tub 303 at the front, instead of at the rear.

Figure 31A:
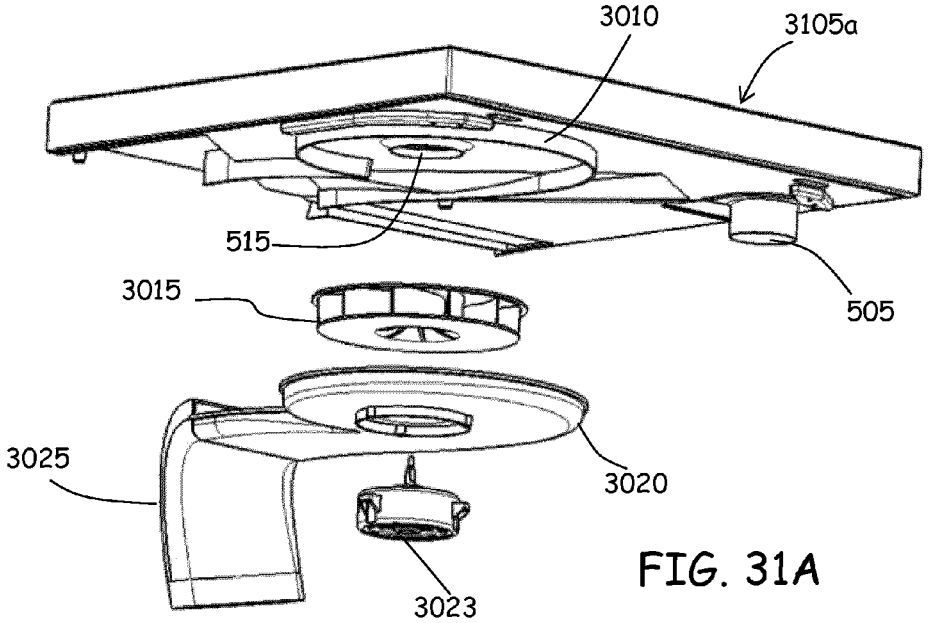
FIGS. 31A and 31B shows in perspective view from below variants of the worktop of FIGS. 1-27, wherein part of a fan housing is integrally formed with the worktop.
Figure 31B:
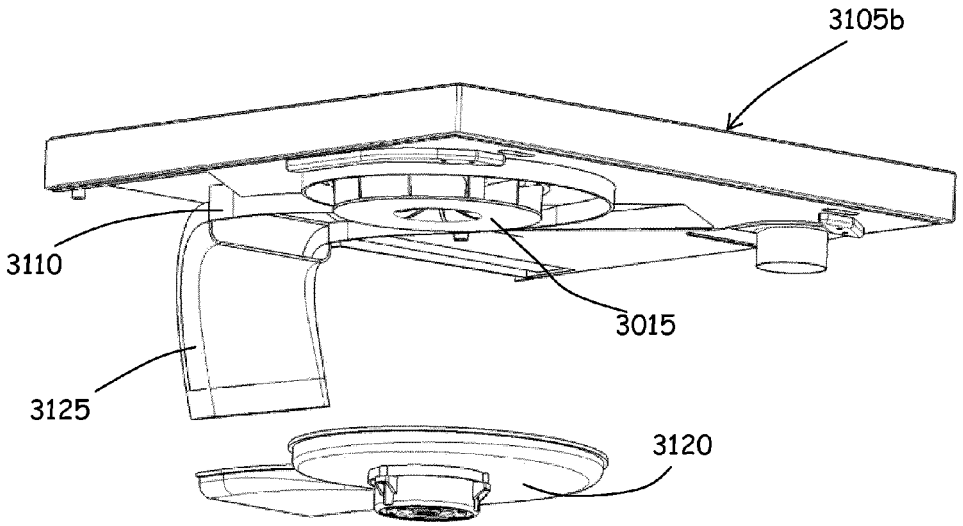

At least part of the fan housing may be formed integrally to the top (preferably, at least a part of the top and at least part of the fan housing form a single piece construction, for example made by injection moulding process); for example, as visible in FIG. 30, an upper half-shell 3010 of the fan housing is formed integrally with the base element 2805, below the bottom wall 2915 of the base element 2805. A fan wheel 3015 is rotatably accommodated in a space delimited by the upper half-shell and a bottom half-shell 3020 of the fan housing, and a fan motor 3023 is mounted outside the bottom half-shell 3020. In the embodiment shown in FIG. 30, an air delivery duct 3025 delivering the air impelled by the fan wheel to the tub 303 is formed integrally with the bottom half-shell 3015. FIG. 31A shows that, identically to FIG. 30, the integration of at least part of the fan housing is possible as well in a top 119 according to the embodiments of FIGS. 1-20 or of of FIGS. 21-27, with the two openings 510 and 515 or 2205 and 2210 formed in the base element 3105*a* of the top. FIG. 31B shows an embodiment in which the air delivery conduit 3125 is integral to the upper half-shell 3110, i.e. integral with the base element 3105*b;* it is intended that the same solution can be applied to the top of FIGS. 28-30, with the rear openings 2810 and 2815. Further, it is to be noted that the air delivery duct 3025 described above can be fluidly connected to a rear part of the tub 303 instead of being connected to a front part of the tub 303 as depicted in FIGS. 28-31B.

Figure 34:
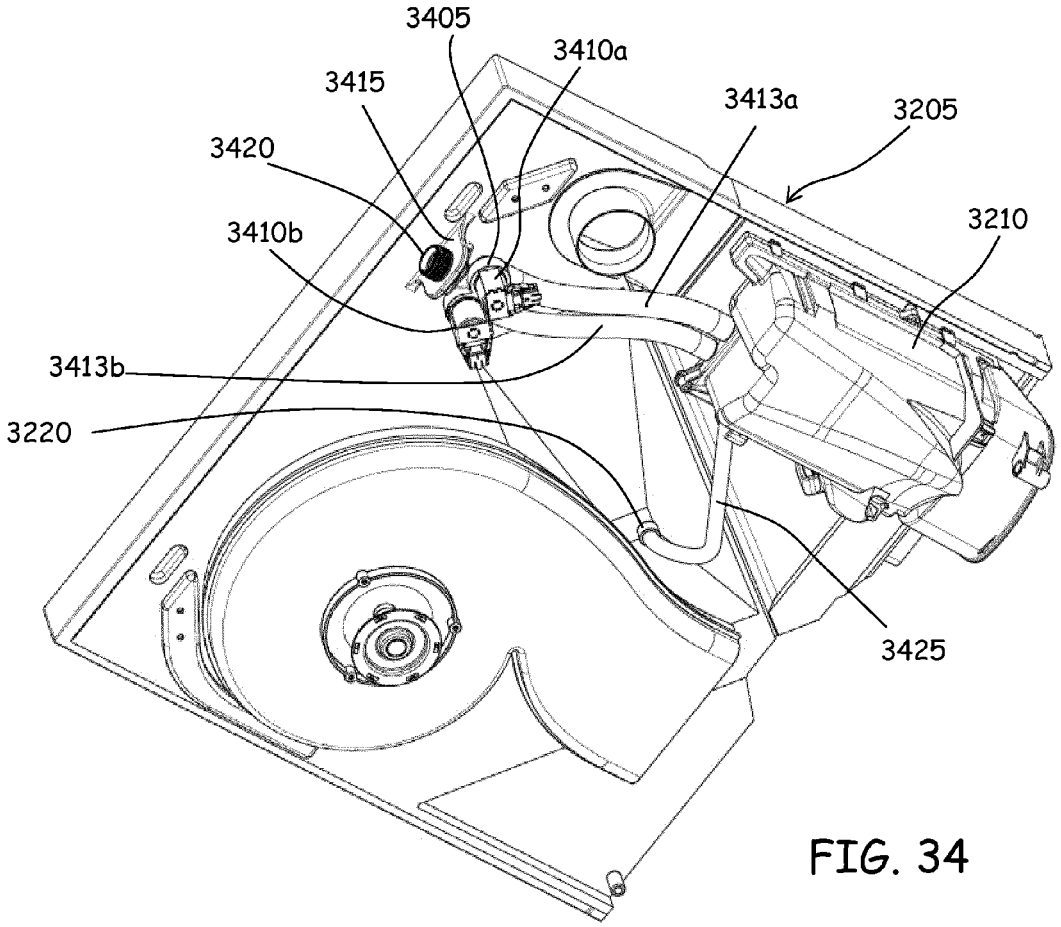
FIGS. 32-34 show in perspective views a worktop according to another embodiment of the present invention, wherein a seat for a detergent/softener container is also integrally formed in the worktop.
Figure 32:
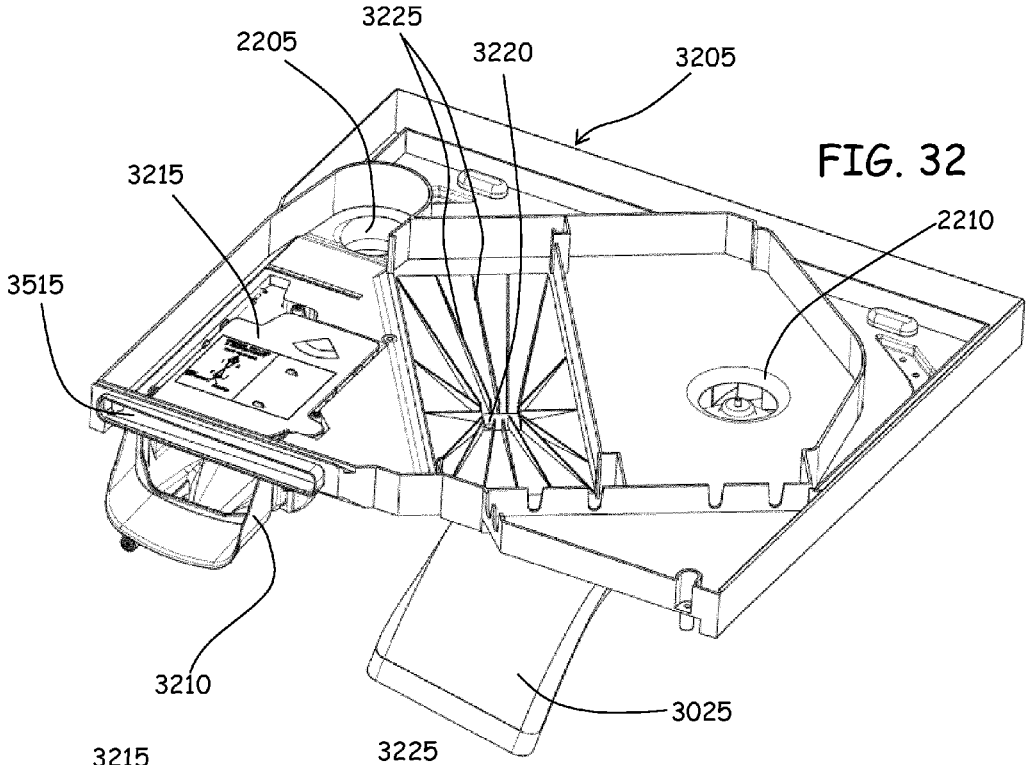
Figure 33:
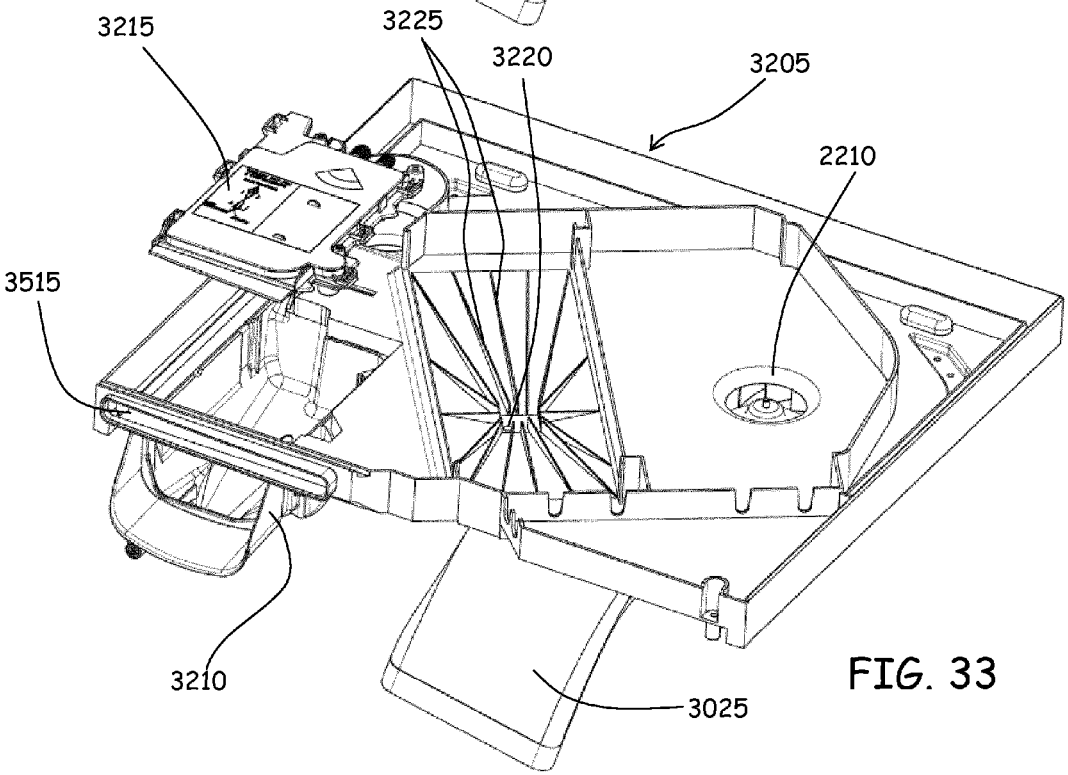

FIGS. 32-34 show another embodiment of top 119 according to the present invention, in which a seat 3210 for a container of detergents/softener is also formed integrally to the top 119, particularly integrally to the base element 3205 (preferably, at least a part of the top and the seat form a single piece construction, for example made by injection moulding process). The detergent container (not shown in the drawings) may be in the usual form of a drawer, slidably accommodated within the seat 3210. The seat 3210 projects below the bottom wall of the base element 3205 and is open on the above, being closed by a removable water delivery assembly 3215 comprising means for delivering water selectively into different compartments of the detergent drawer. Above the assembly 3215, a drying air line is arranged for conveying drying air from opening 2205 to the evaporator and the defluff filter is arranged along the drying air line upstream the evaporator as described for the embodiments of FIG. 21, 22A, 23, the filter being extractable from the machine through the slot 3515 provided at the front wall of the top.

Advantageously, as shown in FIG. 34, a support 3405 for water inlet electrovalves 3410*a*, 3410*b* is also formed integrally to the base element 3205 (preferably, at least a part of the top and the support form a single piece construction, for example made by injection moulding process), with pipes 3413*a*, 3413*b* that fluidly connects the electrovalve outlets to the water delivery assembly 3215. Also formed integrally to the base element may be a bracket 3415 for supporting a pipe union 3420 for the connection (through a conventional hose) to a socket of a water main. In an alternative embodiment, the water inlet electrovalves 3410*a*, 3410*b* can be supported by the bracket 3415. Preferably, at least a part of the top and the support form a single piece construction, for example made by injection moulding process.

Figure 25:
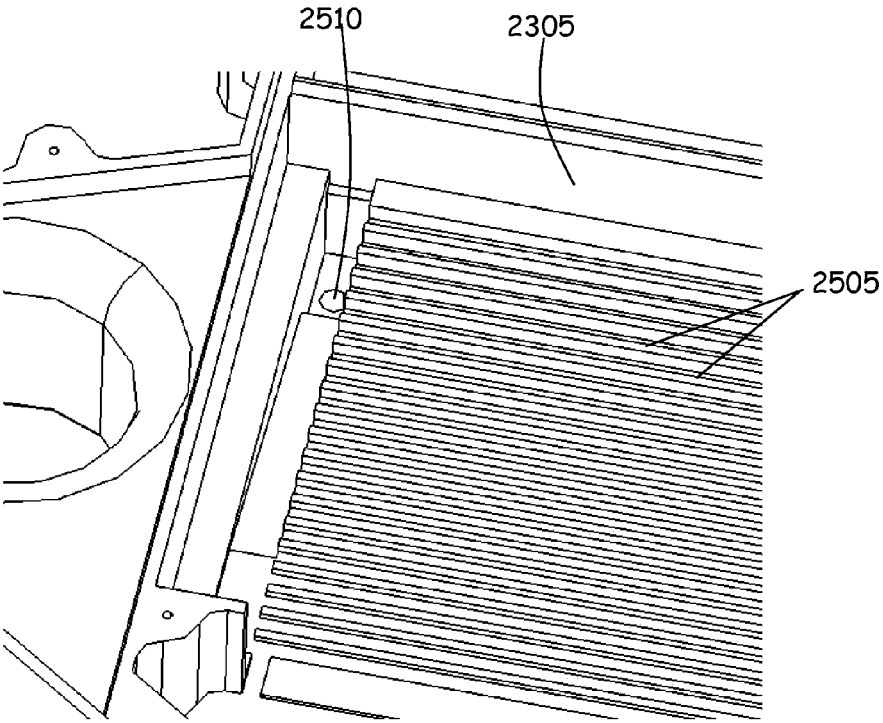
FIG. 25 shows a detail of the worktop of FIG. 21.
Figure 26:
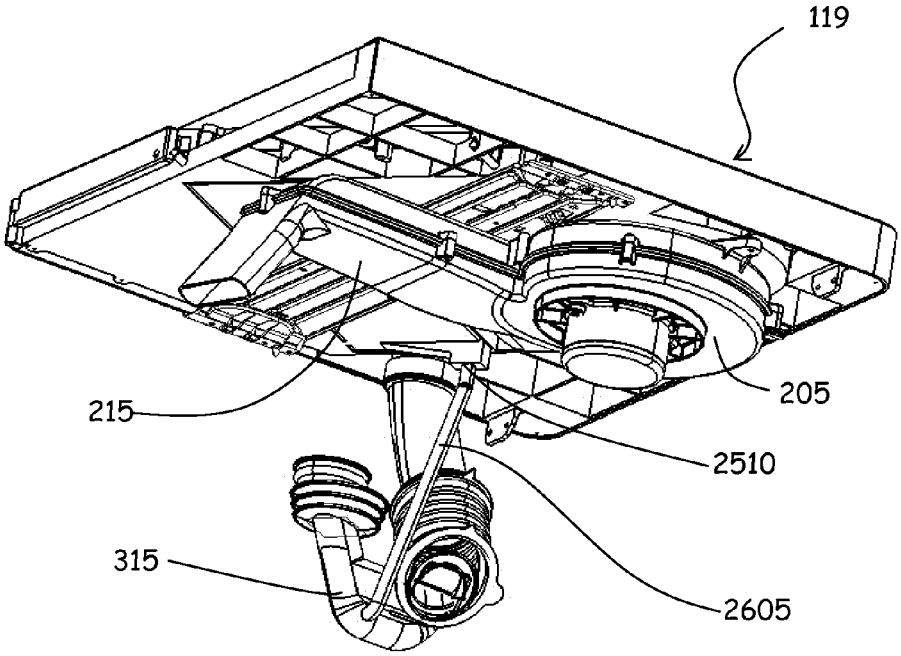
FIG. 26 shows an arrangement for draining condense water from the worktop of FIG. 25.

Also visible in FIGS. 32 and 33 is a variant of the solution shown in FIG. 25 for facilitating the drainage of condense water dripping from the evaporator of the heat pump of the moisture condensing system. The area of the base element 3205 under the evaporator is concave and has a drainage hole 3220 formed essentially at the center thereof; ribs 3225 departs approximately radially from the drainage hole 3220, upon which ribs 3225 the evaporator lies. The area of the base element 3205 under the evaporator, the drainage hole 3220 and the ribs 3225 are integrally provided to the top and preferably, at least a part of the top the area of the base element 3205 under the evaporator and/or the drainage hole 3220 and/or the ribs 3225 form a single piece construction for example by injection moulding.

The drainage hole 3220 is, as shown in FIG. 34, connected through a hose 3425 to the seat 3210 for the detergent container, so that the condense water can be discharged into the manifold 315 or directly into the tub 303 via the seat 3210 for the detergent container.

Figure 35A:
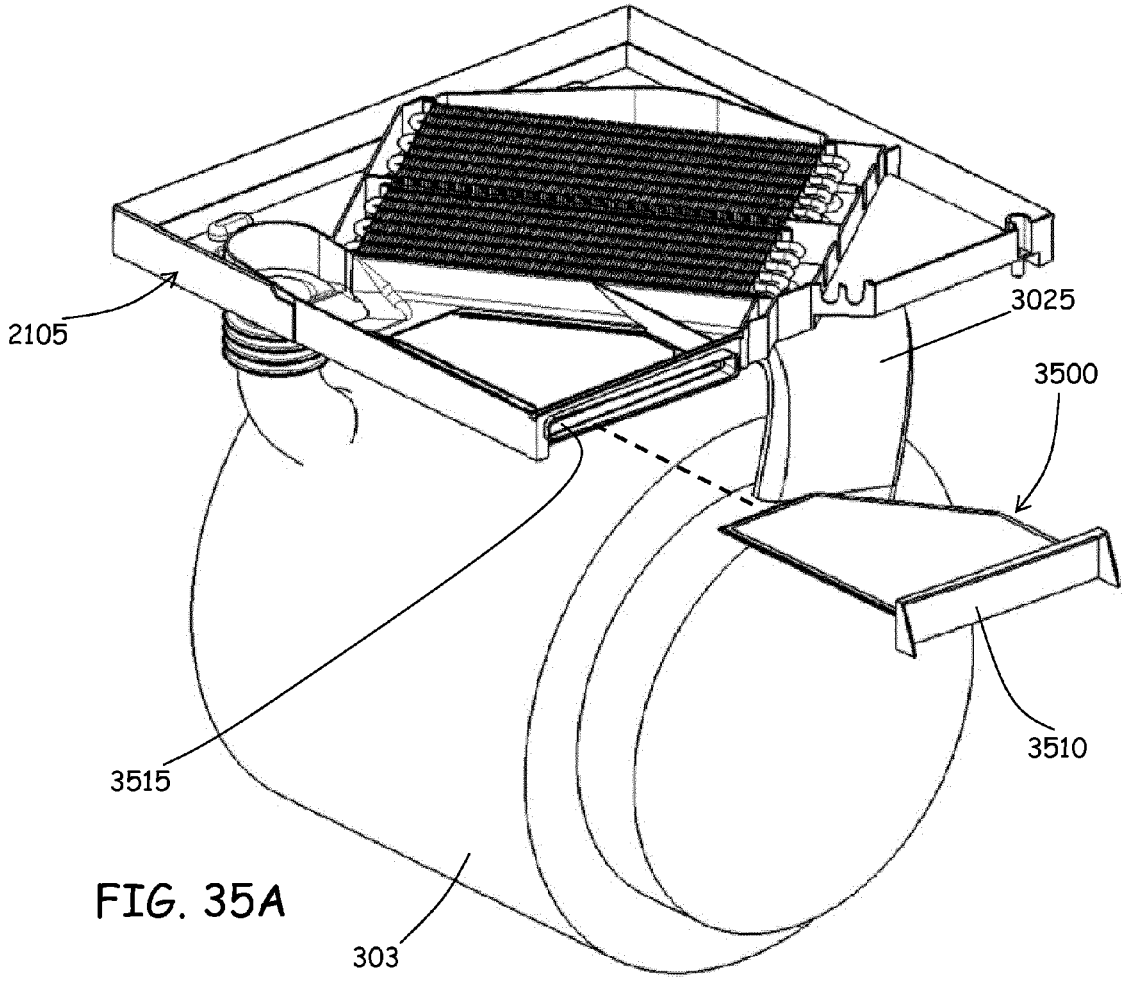
FIGS. 35A and 35B show an alternative construction for a defluff filter.
Figure 35B:
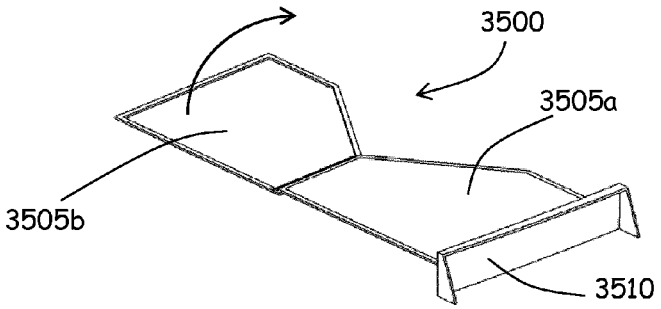

FIGS. 35A and 35B show a variant of the defluff filter located upstream the evaporator and described in connection with the previous embodiments. The defluff filter 3500 has a foldable construction, with a first wing 3505*a* connected to a handle 3510 and a second wing 3505*b* hinged to the first wing. The defluff filter 3500 can be extracted from its seat in the top 119 through a slot 3515 provided in a front wall of the base element of the top, and be unfolded for being cleaned.

FIGS. 36-39 schematically show some variants of a solution for automatically cleaning the evaporator of the heat pump of the moisture condensing system, in order to remove possible fluff that is not retained by the defluff filter, or to allow dispensing for the need of providing the defluff filter. In FIGS. 36-39, the parts within the dashed rectangle 3600 are intended to be accommodated within the ready-to-mount top 119 or to be mounted thereto; reference numerals 3605, 3610, 3615 and 3620 denote the main components of the heat pump, i.e., respectively, the evaporator 3605, the condenser 3610, the compressor 3615 and a lamination valve 3620 (however, the compressor may in some embodiments be external the top).

Figure 36:
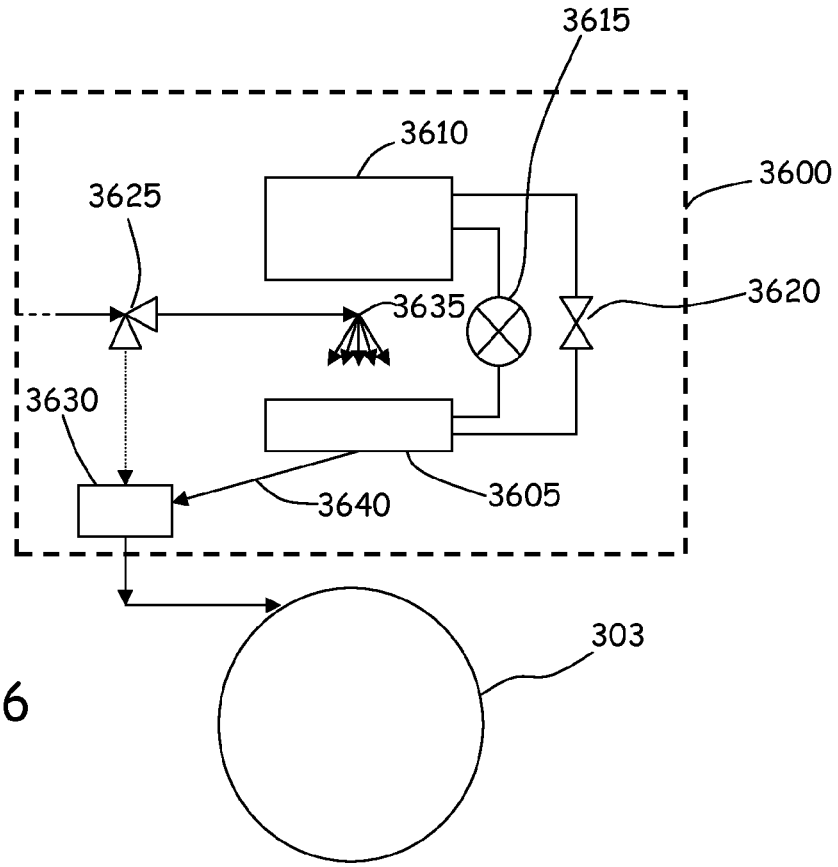

In the variant of FIG. 36, a three-way valve 3625 (for example) can be provided, which is operable to divert the water entering the appliance from the water main to either the detergent container 3630 (which, in the non-limitative example herein considered, may be for example a drawer slidably accommodated in a seat integrally formed in the top 119, like for example shown in FIGS. 32-34) or to a nozzle 3635 arranged in the area of the top 119 where the evaporator 3605 is accommodated, in order to sprinkle water onto it; the three-way valve 3625 may be mounted directly to the top 119. The nozzle 3635, as shown in FIG. 40, may be a hole formed in a wall 4005 of the top base element where the evaporator is accommodated, and the evaporator can be covered by a perforated panel 4010, so that a space is provided above the evaporator to contain and dispense the water intended to flush the evaporator. The water used to wash the evaporator 3605 then returns, through a discharge duct 3640, to the detergent container 3630. In this case, the pressure of the water in the water main is exploited. It is to be noted that to remove efficiently the fluff from the evaporator it is possible to wash with water only the end portion of the evaporator that first meets the drying air stream, which portion tends obviously to collect most of the fluff present in the drying air.

Figure 37:
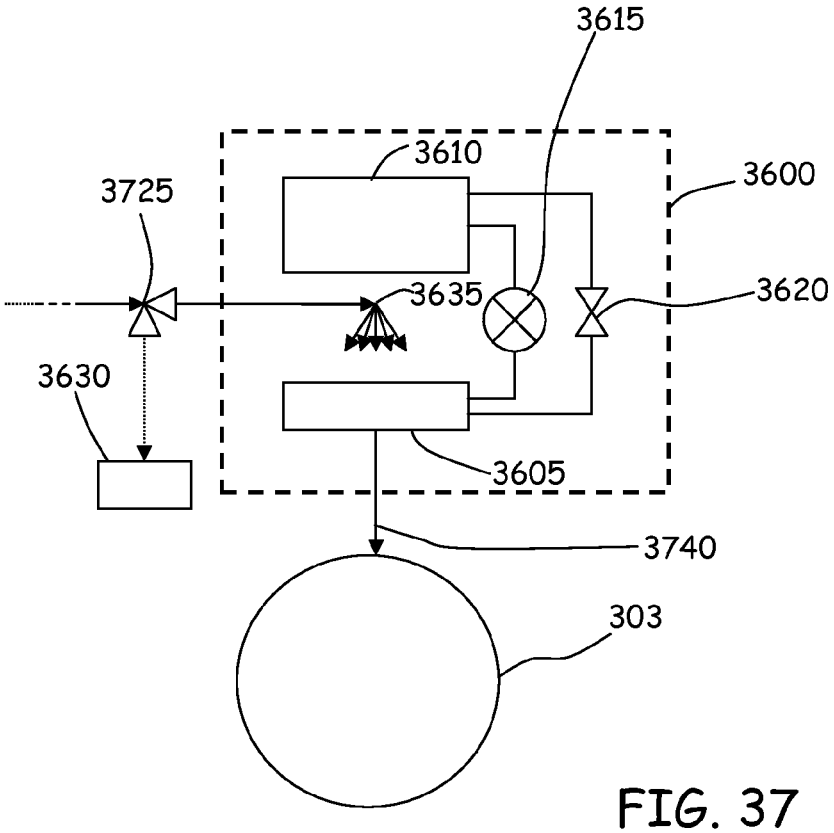

The variant of FIG. 37 differs from that of FIG. 36 mainly in that the discharge of the water used to wash the evaporator is made directly into the washing tub 303, through a discharge duct 3740; in FIG. 37 the detergent container 3630 and the three-way valve 3725 are depicted as not integrally formed with the top 119, but nothing prevents from having one or both of them integrated.

Figure 38:
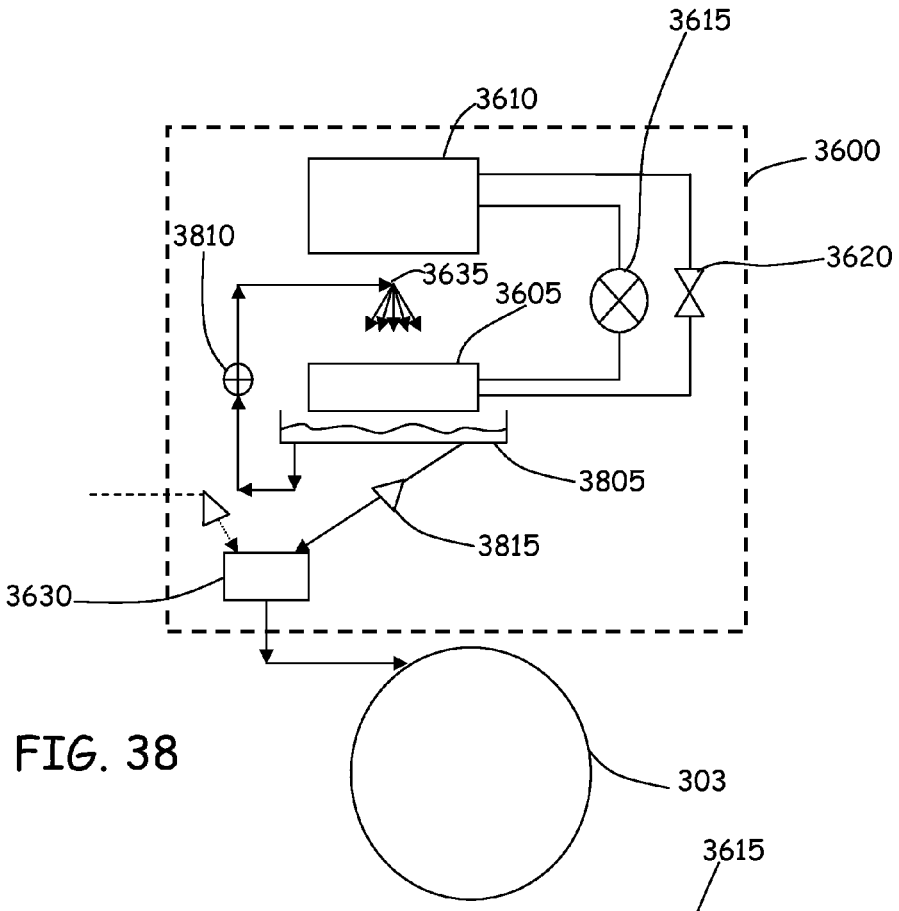
Figure 39:
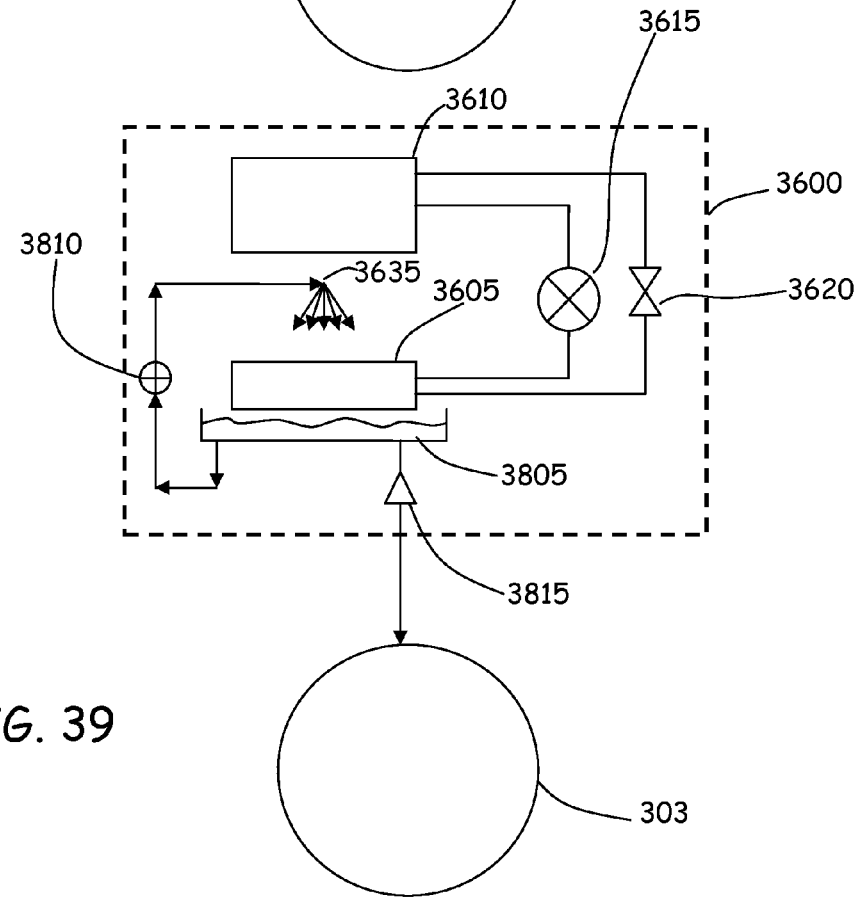
Figure 43:
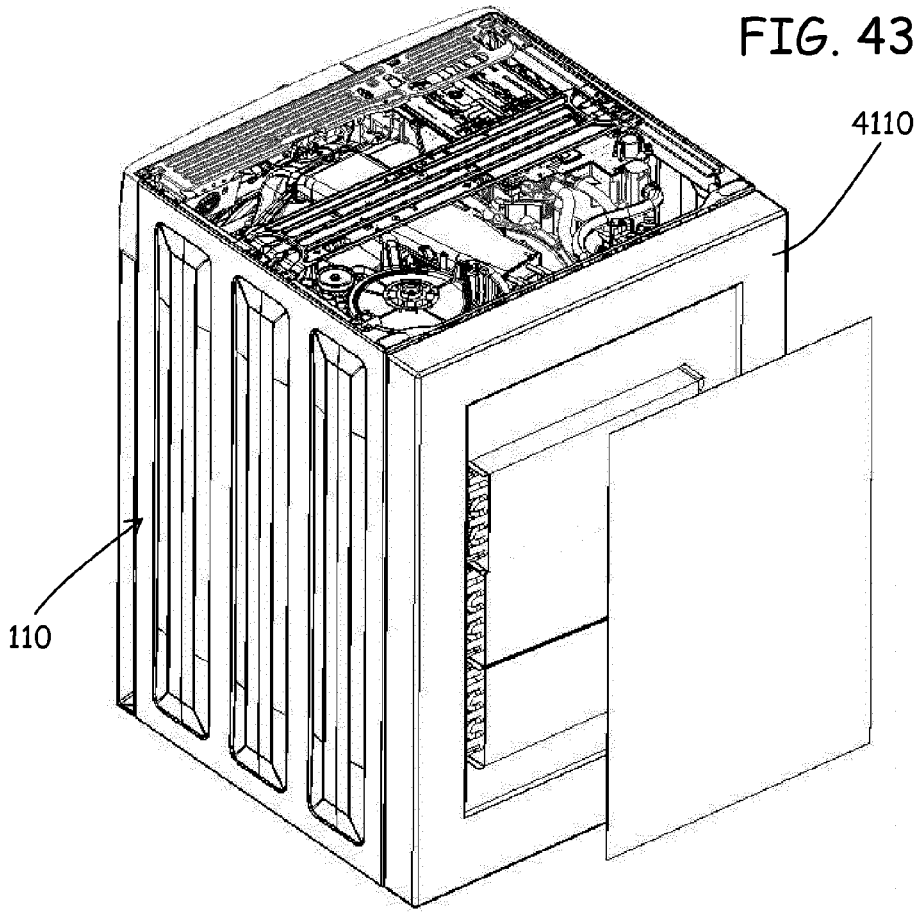
Figure 44:
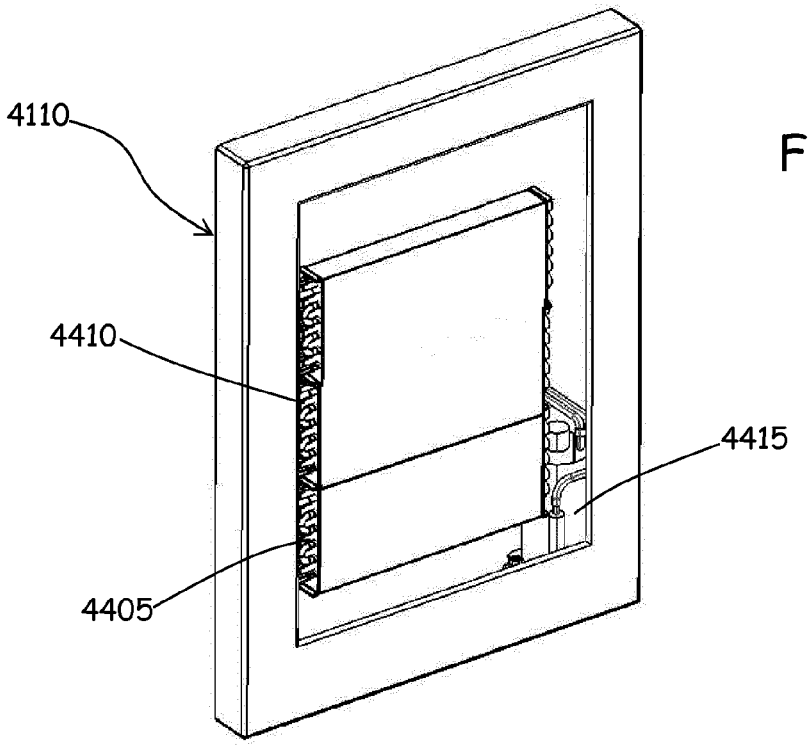
Figure 45:
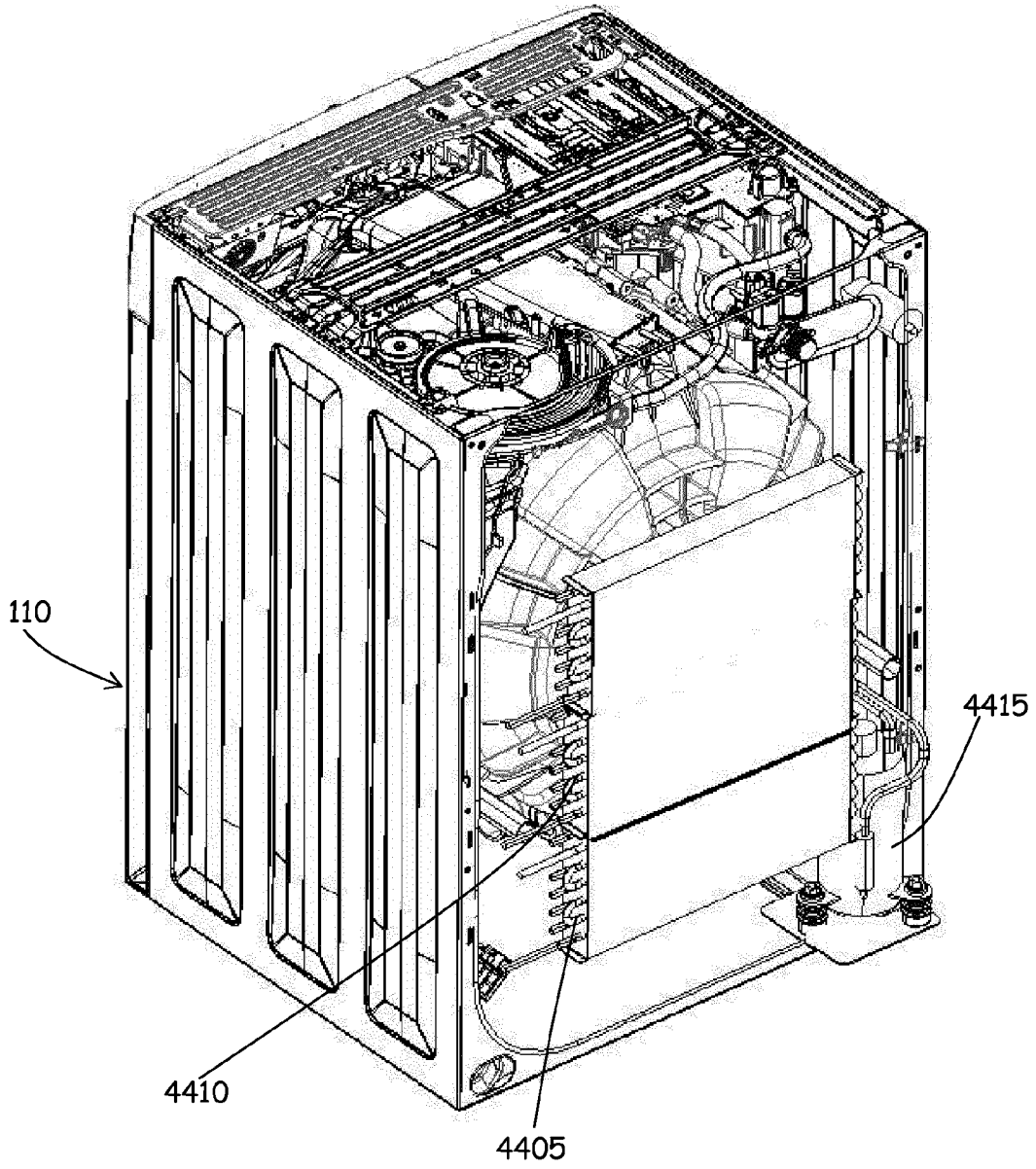

The variants of FIGS. 38 and 39 differ from those of FIGS. 36 and 37 in that the water used to wash the evaporator is condense water that is collected in a basin 3805 properly arranged in the top 119 so as to collect condense water dropping from the evaporator 3605. Condense water collected in the basin 3805 is recirculated, by a pump 3810, from the basin 3805 to the nozzle 3635, from where it is sprinkled onto the evaporator 3605, and then is collected back in the basin 3805. The condense water in the basin 3805 may be discharged either into the detergent container 3630 (FIG. 38) or directly into the tub 303 (FIG. 39), in any case a valve 3815 being provided for selectively enabling the discharge of the condense water present in the basin 3805. The presence of the pump 3810 is in this case preferable because no advantage can be taken of the pressure of the water of the water main. Preferably, a filter may be provided to retain the fluff contained in the condensed water and preferably the filter is arranged upstream the pump 3810.

Preferably the basin 3805 is formed integrally to the ready-to-mount top, preferably, at least a part of the top and the basin form a single piece construction, for example made by injection moulding process.

In an alternative embodiment the basin 3805 can be fluidly connected directly either to the seat 3210 of the detergent container or to the tub 303 by means of a siphon-like system without the need of the valve 3815 so that when the level of the condensed water in the basin 3805 is higher than a predetermined level the excess of water flow by gravity towards the seat 3210 of the detergent container or the tub 303. The basin 3805 is shaped and sized so as to guarantee that the amount of condensed water to be contained in it is appropriate to clean/wash the evaporator.

Essentially, the variants of FIGS. 36-39 share the common feature that at least part of a water circuit for providing water to clean/wash the evaporator is arranged/integrated in the top, preferably, at least a part of the top and at least a part of the water circuit form a single piece construction, for example made by injection moulding process. The seat for the detergent container 3630 can be not integrally formed in the top 119. Further the valve 3625 or the pump 3810 can be simply connected or connectable to the water circuit for cleaning the evaporator but not provided integrally with the top (i.e. arranged inside or at the top like the valves 3410*a* and 3410*b* depicted in FIGS. 34), which means that once the top is coupled to the cabinet of laundry drying appliance, the water circuit to be connected to the valve 3625 or to the pump 3810 already present in the cabinet of laundry drying appliance or, as an alternative, the valve 3625 or the pump 3810 are connected to the water circuit of the top and when the top is to be coupled to the cabinet of laundry drying appliance, the valve 3625 and the pump 3810 are to be arranged at appropriate seats provided in the cabinet of laundry drying appliance.

It is pointed out that the underlying principle of the solutions shown in FIGS. 36-39 of automatically washing the evaporator exploiting water coming from the water main or the condense water dripping from the evaporator itself, is not necessarily linked to the fact that the heat pump (as well as other components of the dryer) is integrated in a ready-to-mount worktop.

It is to be noted that in case of automatically cleaning the evaporator exploiting water coming from the water main, the laundry drying appliance is advantageously a washer/dryer to be connected to the water main for receiving the laundry washing/rinsing water, this is of course valid also for a laundry drying appliance having the top described above.

The washing of the evaporator may take place automatically at any time, or during a washing phase of the appliance, for example during the rinsing. For this purpose the laundry appliance comprises a controller adapted to selectively actuate at least a valve (for example the valve 3625 described above) for feeding water to a water circuit, which conveys water to the evaporator to remove the fluff. Preferably, the controller actuates the valve during a laundry washing phase of the appliance and still preferably, during a rinsing phase. Alternatively or additionally the washing of the evaporator may also be commanded by a user, through the user interface of the appliance, for example the evaporator cleaning can be activated by means of a button or the like provided on the user interface. The actuation of the button enables the controller to actuate the valve accordingly. Further, the appliance can comprise visual and/or acoustic means (display, loudspeaker and similar) for informing the user that the evaporator needs to be cleaned and that the evaporator cleaning shall be carried out. Preferably the electronic circuit of the appliance is adapted to calculate how many cycles have been performed from the last evaporator cleaning (i.e. last actuation of the valve for feeding the water to the water circuit) and to operate the visual and/or acoustic means accordingly. The water used to clean the evaporator can be directed to the seat of the detergent container, or to the tub, or to a drain pump Finally, FIGS. 41-45 show an embodiment wherein the moisture condensing module of the dryer, instead of being formed as a ready-to-mount top, is formed as a ready-to-mount lateral panel of the appliance cabinet 110, for example a rear panel 4110, as in the example shown. In particular, in FIGS. 41-45 the moisture condensing module is assumed to comprise, as moisture condensing means, a heat pump, which, in a way totally similar to what shown in FIGS. 21-26, includes an evaporator 4405, a condenser 4410, a compressor 4415; however, nothing prevents from integrating in the lateral (e.g. rear) panel a moisture condensing module like that of FIGS. 1-20, including as moisture condensing means an air-air heat exchanger. Openings 4105 and 4115 are provided in the panel 4110, which, similarly to the openings 510, 515, allows the entrance and exit of the drying air into/from the moisture condensing module. The compressor 4415 may, in a variant, be attached to the panel 4410.

It is underlined that the various embodiments and variants here described are independent one from the other and may also be implemented in various combinations.

The invention claimed is:

1. A top adapted to match and close from above a cabinet of a laundry drying appliance, the top being formed as a ready-to-mount part ready to be mounted to the cabinet and forming a moisture condensing module for dehydrating drying air used to dry laundry within a drying drum of the laundry drying appliance, the top having a top surface, a bottom surface, and a lateral wall and comprising:

a drying air inlet for receiving moisture-laden drying air, a drying air outlet for delivering dehydrated drying air, wherein the drying air inlet and the drying air outlet are either provided on the bottom surface or on the lateral wall, fluid passageways defined thereinside from said drying air inlet to said drying air outlet for the passage of the drying air to be dehydrated, and a moisture condenser arranged inside said fluid passageways, wherein:

the moisture condenser is an air-air heat exchanger or a heat exchanger of a heat pump circuit, and the top further comprises, integrally formed therein, at least one structural part of the appliance, said at least one structural part of the appliance comprising at least one of the following:

a part of a housing of a fan operable for propelling the drying air;

a drying air delivery duct connectable to a drying air inlet of the drying drum for delivering the drying air into the drying drum;

a seat for a container of detergents/softener for washing laundry;

a condense water collector for collecting condense water released by the moisture-laden drying air;

at least part of a condense water draining system;

a support for at least one water inlet valve for selectively allowing the intake of water from a water main; and at least part of a water circuit for delivering water to clean the moisture condensing means.

2. The top of claim 1, comprising the part of a housing of a fan, wherein said part of fan housing that is formed integrally to the top defines a first half-shell of the fan housing, to which a part defining a second half-shell is couplable for defining a shell accommodating therein a fan wheel.

3. The top of claim 2, comprising the drying air delivery duct wherein said drying air delivery duct is formed integrally to one of: the part of fan housing that is formed integrally to the top; and the part defining the second half-shell.

4. The top of claim 1, comprising the at least part of a condense water draining system, the condense water collector, and the seat for the detergents/softener container, wherein the condense water draining system comprises a conduit fluidly connecting the condense water collector to the seat for the detergents/softener container.

5. The top of claim 4, wherein the top further comprises a water delivery assembly comprising a water deliverer for delivering water into the seat for the detergents/softener container.

6. The top of claim 4, wherein the detergents/softener container is a drawer slidably accommodated within the seat and having one or more detergents/softener compartments.

7. The top of claim 1, comprising the at least part of the water circuit for delivering water to clean the moisture condensing means, the at least part of the water circuit comprises at least one nozzle for sprinkling water onto the moisture condenser, said nozzle being fed with water coming either from said water main or from said condense water collecting means.

8. The top of claim 7, wherein said at least part of the water circuit for delivering water to clean the moisture condenser is connected or connectable to a pump for pumping the water from the condense water collector to said nozzle.

9. The top of claim 7, wherein said at least part of the water circuit for delivering water to clean the moisture condenser comprises at least one pump for pumping the water from the condense water collector to said nozzle.

10. The top of claim 7, wherein said at least part of the water circuit for delivering water to clean the moisture condenser is connected or connectable to at least one valve for selectively feeding water from the water main to said nozzle.

11. The top of claim 7, wherein said at least part of the water circuit for delivering water to clean the moisture condenser comprises at least one valve for selectively feeding water from the water main to said nozzle.

12. The top of claim 1, wherein said moisture condenser comprises said heat exchanger of a heat pump circuit, said heat exchanger being operable for cooling and dehydrating the moisture-laden drying air.

13. A laundry drying appliance, comprising a cabinet having a top, a rotatable drying drum accommodated within the cabinet, and a laundry drying air circulation system for circulating drying air, wherein the top is in accordance to claim 1 and wherein the drying air circulation system comprises a drying air drum outlet connectable to the drying air inlet of the top, and a drying air drum inlet connectable to the drying air outlet of the top.

14. The top of claim 2, wherein said at least part of a condense water draining system comprises a conduit fluidly connecting the condense water collector to the seat for the detergents/softener container.

15. The top of claim 3, wherein said at least part of a condense water draining system comprises a conduit fluidly connecting the condense water collector to the seat for the detergents/softener container.

* * * * *